US011659646B2

(12) United States Patent
Yamasaki et al.

(10) Patent No.: US 11,659,646 B2
(45) Date of Patent: May 23, 2023

(54) TARGET SUPPLY DEVICE, EXTREME ULTRAVIOLET LIGHT GENERATION APPARATUS, AND ELECTRONIC DEVICE MANUFACTURING METHOD

(71) Applicant: Gigaphoton Inc., Tochigi (JP)

(72) Inventors: Koji Yamasaki, Oyama (JP); Fumio Iwamoto, Oyama (JP)

(73) Assignee: Gigaphoton Inc., Tochigi (JP)

( * ) Notice: Subject to any disclaimer, the term of this patent is extended or adjusted under 35 U.S.C. 154(b) by 100 days.

(21) Appl. No.: 17/493,407

(22) Filed: Oct. 4, 2021

(65) Prior Publication Data

US 2022/0159818 A1 May 19, 2022

(30) Foreign Application Priority Data

Nov. 18, 2020 (JP) ..... JP2020-191478

(51) Int. Cl.
*H05G 2/00* (2006.01)

(52) U.S. Cl.
CPC ..... *H05G 2/006* (2013.01); *H05G 2/008* (2013.01)

(58) Field of Classification Search
CPC ..... H05G 2/006; H05G 2/008
See application file for complete search history.

(56) References Cited

U.S. PATENT DOCUMENTS 8,841,639 B2 9/2014 Yabu et al.
10,225,917 B2 3/2019 Fujimaki et al.

*Primary Examiner* — Nicole M Ippolito
*Assistant Examiner* — Hanway Chang
(74) *Attorney, Agent, or Firm* — Studebaker & Brackett PC

(57) ABSTRACT

A target supply device may include a tank configured to store a target substance, a pressure adjuster configured to adjust a pressure in the tank, a filter configured to filter the target substance in the tank, a nozzle configured to output a droplet of the target substance having passed through the filter, a droplet detector configured to detect outputting of the droplet from the nozzle, and a processor configured to control the pressure adjuster so that a pressure-increasing speed of the pressure in the tank is higher after detection of outputting of the droplet than before detection of outputting of the droplet, during a period in which the pressure in the tank is increased to a target pressure from a pressure at which outputting of the droplet is detected by the droplet detector for the first time after installation of the target supply device.

17 Claims, 12 Drawing Sheets

TARGET SUPPLY DEVICE, EXTREME ULTRAVIOLET LIGHT GENERATION APPARATUS, AND ELECTRONIC DEVICE MANUFACTURING METHOD

CROSS-REFERENCE TO RELATED APPLICATIONS

The present application claims the benefit of Japanese Patent Application No. 2020-191478, filed on Nov. 18, 2020, the entire contents of which are hereby incorporated by reference.

BACKGROUND

1. Technical Field

The present disclosure relates to a target supply device, an extreme ultraviolet light generation apparatus, and an electronic device manufacturing method.

2. Related Art

Recently, miniaturization of a transfer pattern in optical lithography of a semiconductor process has been rapidly proceeding along with miniaturization of the semiconductor process. In the next generation, microfabrication at 10 nm or less will be required. Therefore, it is expected to develop a semiconductor exposure apparatus that combines an apparatus for generating extreme ultraviolet (EUV) light having a wavelength of about 13 nm with a reduced projection reflection optical system.

As the EUV light generation apparatus, a laser produced plasma (LPP) type apparatus using plasma generated by irradiating a target substance with laser light has been developed.

LIST OF DOCUMENTS

Patent Documents

Patent Document 1: U.S. Pat. No. 8,841,639
Patent Document 2: U.S. Pat. No. 10,225,917

SUMMARY

A target supply device according to an aspect of the present disclosure includes a tank configured to store a target substance, a pressure adjuster configured to adjust a pressure in the tank, a filter configured to filter the target substance in the tank, a nozzle configured to output a droplet of the target substance having passed through the filter, a droplet detector configured to detect outputting of the droplet from the nozzle, and a processor configured to control the pressure adjuster so that a pressure-increasing speed of the pressure in the tank is higher after detection of outputting of the droplet than before detection of outputting of the droplet, during a period in which the pressure in the tank is increased to a target pressure from a pressure at which outputting of the droplet is detected by the droplet detector for the first time after installation of the target supply device.

An extreme ultraviolet light generation apparatus according to an aspect of the present disclosure includes a chamber device including a plasma generation region, a target supply device configured to supply a droplet of a target substance to the plasma generation region, and a laser device configured to irradiate the droplet with laser light so that plasma is generated from the droplet in the plasma generation region. Here, the target supply device includes a tank configured to store the target substance, a pressure adjuster configured to adjust a pressure in the tank, a filter configured to filter the target substance in the tank, a nozzle configured to output the droplet of the target substance having passed through the filter, a droplet detector configured to detect outputting of the droplet from the nozzle, and a processor configured to control the pressure adjuster so that a pressure-increasing speed of the pressure in the tank is higher after detection of outputting of the droplet than before detection of outputting of the droplet, during a period in which the pressure in the tank is increased to a target pressure from a pressure at which outputting of the droplet is detected for the first time by the droplet detector after installation of the target supply device.

An electronic device manufacturing method according to an aspect of the present disclosure includes generating plasma by irradiating a target substance with laser light using an extreme ultraviolet light generation apparatus, emitting extreme ultraviolet light generated from the plasma to an exposure apparatus, and exposing a photosensitive substrate to the extreme ultraviolet light in the exposure apparatus to manufacture an electronic device. Here, the extreme ultraviolet light generation apparatus includes a chamber device including a plasma generation region, a target supply device configured to supply a droplet of the target substance to the plasma generation region, and a laser device configured to irradiate the droplet with the laser light so that the plasma is generated from the droplet in the plasma generation region. The target supply device includes a tank configured to store the target substance, a pressure adjuster configured to adjust a pressure in the tank, a filter configured to filter the target substance in the tank, a nozzle configured to output the droplet of the target substance having passed through the filter, a droplet detector configured to detect outputting of the droplet from the nozzle, and a processor configured to control the pressure adjuster so that a pressure-increasing speed of the pressure in the tank is higher after detection of outputting of the droplet than before detection of outputting of the droplet, during a period in which the pressure in the tank is increased to a target pressure from a pressure at which outputting of the droplet is detected for the first time by the droplet detector after installation of the target supply device.

An electronic device manufacturing method according to an aspect of the present disclosure includes generating plasma by irradiating a target substance with laser light using an extreme ultraviolet light generation apparatus, inspecting a defect of a mask by irradiating the mask with extreme ultraviolet light generated from the plasma, selecting a mask using a result of the inspection, and exposing and transferring a pattern formed on the selected mask onto a photosensitive substrate. Here, the extreme ultraviolet light generation apparatus includes a chamber device including a plasma generation region, a target supply device configured to supply a droplet of the target substance to the plasma generation region, and a laser device configured to irradiate the droplet with the laser light so that the plasma is generated from the droplet in the plasma generation region. The target supply device includes a tank configured to store the target substance, a pressure adjuster configured to adjust a pressure in the tank, a filter configured to filter the target substance in the tank, a nozzle configured to output the droplet of the target substance having passed through the filter, a droplet detector configured to detect outputting of the droplet from the nozzle, and a processor configured to control the pressure adjuster so that a pressure-increasing speed of the pressure in the tank is higher after detection of the outputting of the droplet than before detection of the outputting of the droplet, during a period in which the pressure in the tank is increased to a target pressure from a pressure at which the outputting of the droplet is detected for the first time by the droplet detector after installation of the target supply device.

BRIEF DESCRIPTION OF THE DRAWINGS

Embodiments of the present disclosure will be described below merely as examples with reference to the accompanying drawings.

DESCRIPTION OF EMBODIMENTS

Figure 1:
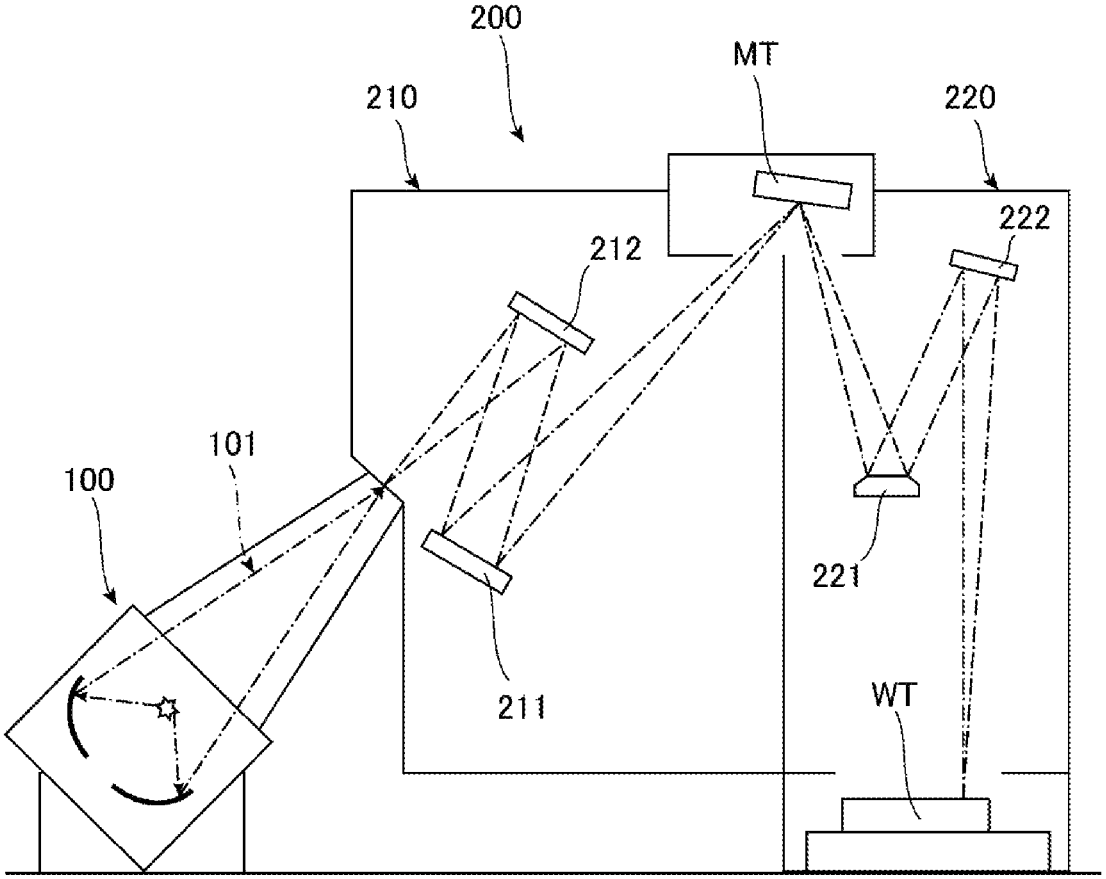
FIG. 1 is a schematic view showing a schematic configuration example of an entire electronic device manufacturing apparatus.

1. Overview
2. Description of electronic device manufacturing apparatus
3. Description of extreme ultraviolet light generation apparatus of comparative example
   3.1 Configuration
   3.2 Operation
   3.3 Problem
4. Description of extreme ultraviolet light generation apparatus of first embodiment
   4.1 Configuration
   4.2 Operation
   4.3 Effect
5. Description of extreme ultraviolet light generation apparatus of second embodiment
   5.1 Configuration
   5.2 Operation
   5.3 Effect
6. Description of extreme ultraviolet light generation apparatus of third embodiment
   6.1 Configuration
   6.2 Operation
   6.3 Effect Hereinafter, embodiments of the present disclosure will be described in detail with reference to the drawings.

The embodiments described below show some examples of the present disclosure and do not limit the contents of the present disclosure. Also, all configurations and operation described in the embodiments are not necessarily essential as configurations and operation of the present disclosure. Here, the same components are denoted by the same reference numerals, and duplicate description thereof is omitted.

1. Overview

Embodiments of the present disclosure relate to an extreme ultraviolet light generation apparatus generating light having a wavelength of extreme ultraviolet (EUV) and an electronic device manufacturing apparatus. In the following, extreme ultraviolet light is referred to as EUV light in some cases.

2. Description of Electronic Device Manufacturing Apparatus

FIG. 1 is a schematic view showing a schematic configuration example of an entire electronic device manufacturing apparatus. The electronic device manufacturing apparatus shown in FIG. 1 includes an EUV light generation apparatus 100 and an exposure apparatus 200. The exposure apparatus 200 includes a mask irradiation unit 210 including a plurality of mirrors 211, 212 that are a reflection optical system, and a workpiece irradiation unit 220 including a plurality of mirrors 221, 222 that are a reflection optical system different from the reflection optical system of the mask irradiation unit 210. The mask irradiation unit 210 illuminates, via the mirrors 211, 212, a mask pattern of the mask table MT with EUV light 101 incident from the EUV light generation apparatus 100. The workpiece irradiation unit 220 images the EUV light 101 reflected by the mask table MT onto a workpiece (not shown) arranged on the workpiece table WT via the mirrors 211, 212. The workpiece is a photosensitive substrate such as a semiconductor wafer on which photoresist is applied. The exposure apparatus 200 synchronously translates the mask table MT and the workpiece table WT to expose the workpiece to the EUV light 101 reflecting the mask pattern. Through the exposure process as described above, a device pattern is transferred onto the semiconductor wafer, thereby a semiconductor device can be manufactured.

Figure 2:
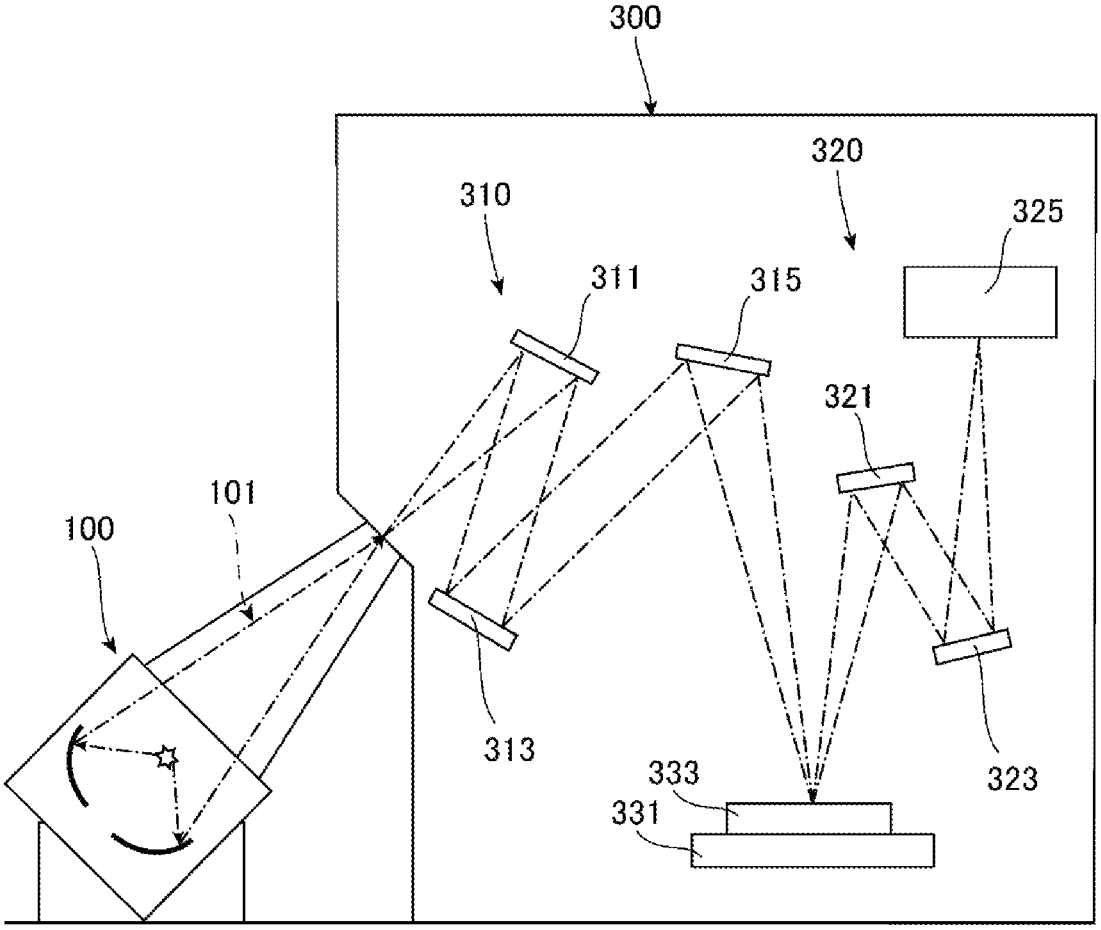
FIG. 2 is a schematic view showing a schematic configuration example of an entire electronic device manufacturing apparatus different from the electronic device manufacturing apparatus shown in FIG. 1.

FIG. 2 is a schematic view showing a schematic configuration example of an entire electronic device manufacturing apparatus different from the electronic device manufacturing apparatus shown in FIG. 1. The electronic device manufacturing apparatus shown in FIG. 2 includes the EUV light generation apparatus 100 and an inspection apparatus 300. The inspection apparatus 300 includes an illumination optical system 310 including a plurality of mirrors 311, 313, 315 that are a reflection optical system, and a detection optical system 320 including a plurality of mirrors 321, 322 that are a reflection optical system different from the reflection optical system of the illumination optical system 310 and a detector 325. The illumination optical system 310 reflects, with the mirrors 311, 313, 315, the EUV light 101 incident from the EUV light generation apparatus 100 to illuminate a mask 333 placed on a mask stage 331. The mask 333 includes a mask blanks before a pattern is formed. The detection optical system 320 reflects, with the mirrors 321, 323, the EUV light 101 reflecting the pattern from the mask 333 and forms an image on a light receiving surface of the detector 325. The detector 325 having received the EUV light 101 obtains an image of the mask 333. The detector 325 is, for example, a time delay integration (TDI) camera. Defects of the mask 333 are inspected based on the image of the mask 333 obtained by the above-described process, and a mask suitable for manufacturing an electronic device is selected using the inspection result. Then, the electronic device can be manufactured by exposing and transferring the pattern formed on the selected mask onto the photosensitive substrate using the exposure apparatus 200.

3. Description of Extreme Ultraviolet Light Generation Apparatus of Comparative Example 3.1 Configuration The EUV light generation apparatus 100 of a comparative example will be described. The comparative example of the present disclosure is an example recognized by the applicant as known only by the applicant, and is not a publicly known example admitted by the applicant. Further, the following description will be given with reference to the EUV light generation apparatus 100 that emits the EUV light 101 toward the exposure apparatus 200 as an external apparatus as shown in FIG. 1. Here, the EUV light generation apparatus 100 that emits the EUV light 101 to the inspection apparatus 300 as an external apparatus as shown in FIG. 2 can obtain the same operation and effect as the EUV light generation apparatus 100 that emits the EUV light 101 toward the exposure apparatus 200.

Figure 3:
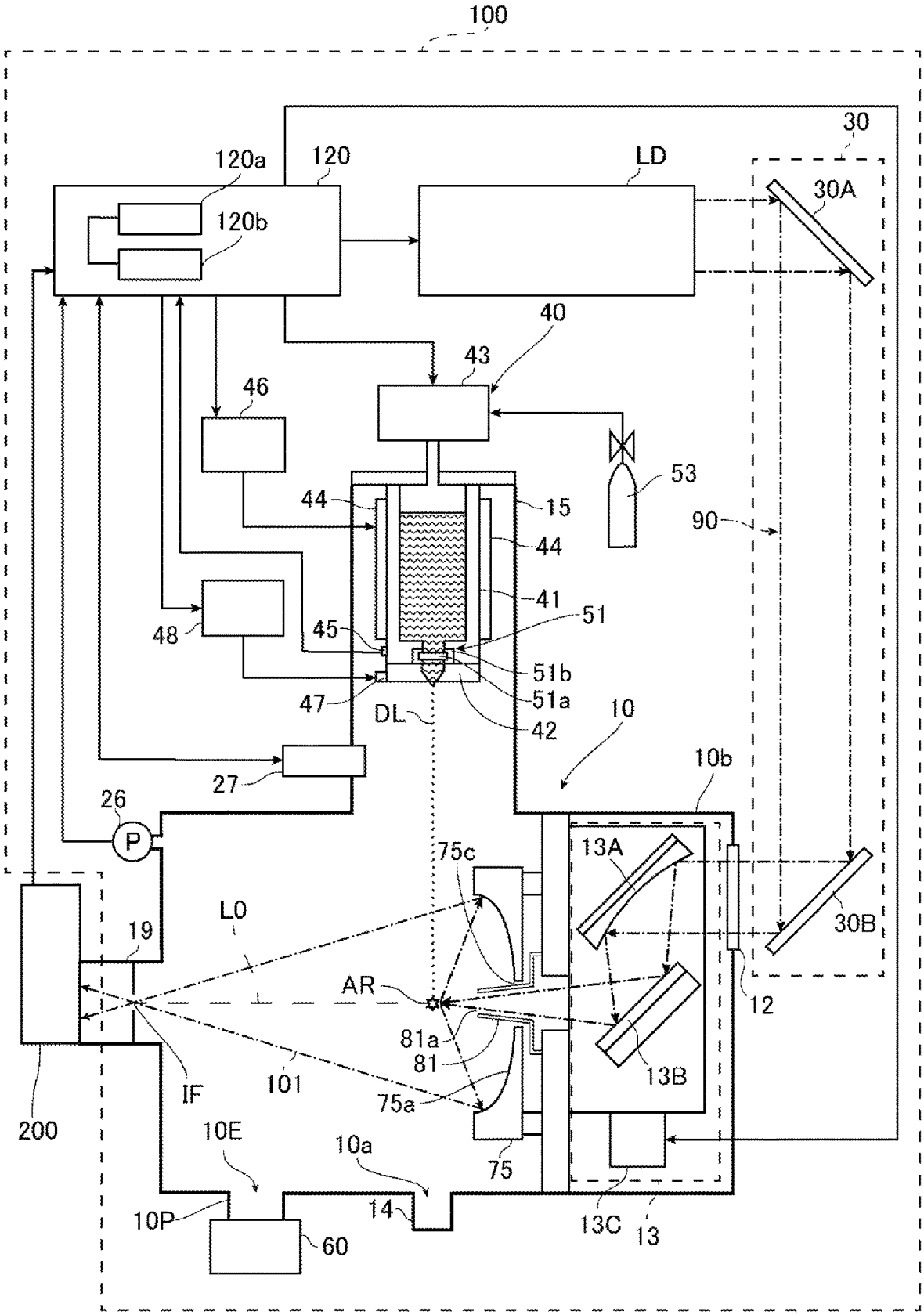
FIG. 3 is a schematic view showing a schematic configuration example of an entire EUV light generation apparatus.

FIG. 3 is a schematic view showing a schematic configuration example of the entire EUV light generation apparatus 100 of the present example. As shown in FIG. 3, the EUV light generation apparatus 100 includes a laser device LD, a chamber device 10, a processor 120, and a laser light delivery optical system 30 as a main configuration.

The chamber device 10 is a sealable container. The chamber device 10 includes an inner wall 10*b* surrounding an internal space having a low pressure atmosphere. The chamber device 10 includes a sub-chamber 15 and a target supply device 40 is arranged in the sub-chamber 15. The target supply device 40 is attached to penetrate through a wall of the sub-chamber 15. The target supply device 40 includes a tank 41, a nozzle 42, and a pressure adjuster 43 to supply a droplet DL to the internal space of the chamber device 10. The droplet DL is also referred to as a target.

The tank 41 stores therein a target substance which becomes the droplet DL. The target substance contains tin. The inside of the tank 41 is in communication with the pressure adjuster 43 which regulates the pressure in the tank 41. A heater 44 and a temperature sensor 45 are attached to the tank 41. The heater 44 heats the tank 41 with current applied from a heater power source 46. Through the heating, the target substance in the tank 41 melts. The temperature sensor 45 measures the temperature of the target substance in the tank 41 through the tank 41. The pressure adjuster 43, the temperature sensor 45, and the heater power source 46 are electrically connected to the processor 120.

The tank 41 also includes a communication portion which communicates with the inside of the tank 41 and the nozzle 42. The communication portion is a flow path through which the target substance flows from the inside of the tank 41 toward the nozzle 42. The communication portion includes an enlarged diameter part having a larger diameter than another part of the communication portion, and a filter unit 51 is accommodated without a gap in the enlarged diameter part.

The filter unit 51 includes a filter 51*a* and a filter holder 51*b*.

The filter 51*a* filters the target substance passing through the filter 51*a* to remove particles from the target substance. The particles are metal oxides such as tin oxide. The filter 51*a* is formed of, for example, a porous member in order to collect particles. Accordingly, numerous through holes are formed in the filter 51*a*, and the diameter of the through holes is, for example, 3 μm or more and 10 μm or less. The thickness of the filter 51*a* is approximately 5 mm. The filter 51*a* may be porous glass. Alternatively, the filter 51*a* may have a structure in which a plurality of porous plate-shaped members are laminated, or may be a plurality of porous ceramics.

The filter 51*a* is arranged in a hollow portion of the cylindrical filter holder 51*b*, and the outer circumferential surface of the filter 51*a* is in close contact with the inner circumferential surface of the filter holder 51*b* without a gap, and sealing is arranged between the outer circumferential surface and the inner circumferential surface. Further, the outer surface of the filter holder 51*b* is in close contact with the inner surface in the enlarged diameter portion without a gap, and sealing is provided between the outer surface and the inner surface.

The nozzle 42 is attached to the tank 41 and outputs the target substance having passed through the filter 51*a*. A piezoelectric element 47 is attached to the nozzle 42. The piezoelectric element 47 is electrically connected to a piezoelectric power source 48 and is driven by voltage applied from the piezoelectric power source 48. The piezoelectric power source 48 is electrically connected to the processor 120. The target substance output from the nozzle 42 is formed into the droplet DL through operation of the piezoelectric element 47.

Material of the tank 41, the nozzle 42, and the filter holder 51*b* has low reactivity with tin as the target substance. Examples of the material include tungsten (W), molybdenum (Mo), and tantalum (Ta).

Figure 4:
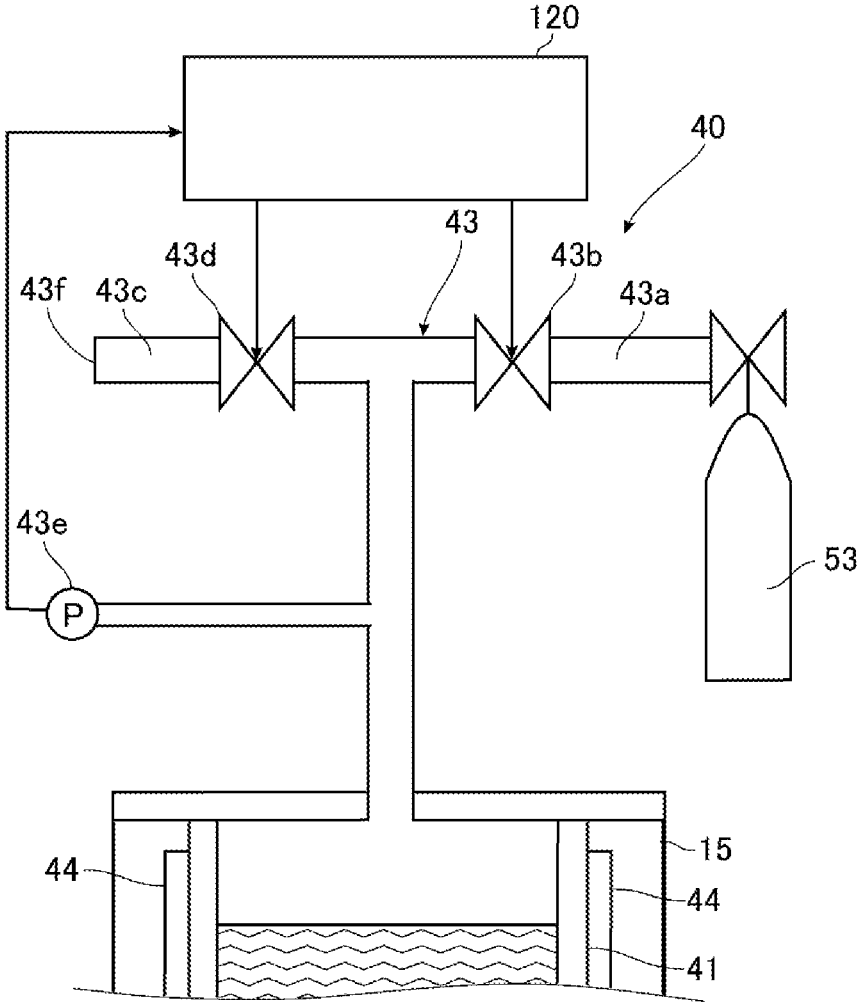
FIG. 4 is a schematic view showing a schematic configuration example of a pressure adjuster.

FIG. 4 is a schematic view showing a schematic configuration example of the pressure adjuster 43.

The pressure adjuster 43 includes a pipe 43*a* communicating with the gas supply source 53 and the inside of the tank 41, a valve 43*b* arranged in the pipe 43*a*, a pipe 43*c* communicating with the pipe 43*a*, a valve 43*d* arranged in the pipe 43*c*, and a pressure sensor 43*e* arranged between the valve 43*b* and the tank 41 in the pipe 43*a*.

The gas supply source 53 is a cylinder filled with inert gas such as argon (Ar) gas and helium (He) gas. The pipe 43*a* is a supply path for supplying the inert gas from the gas supply source 53 into the tank 41. The pipe 43*a* communicates with one end of the pipe 43*c*, and an exhaust port 43*f* is arranged at the other end of the pipe 43*c*. The pipe 43*c* is an exhaust path for exhausting the inert gas in the tank 41 through the exhaust port 43*f*.

The valves 43*b*, 43*d* are control valves for opening and closing the pipes 43*a*, 43*c*. FIG. 4 shows an example in which the valve 43*b* is arranged in the pipe 43*a* between the gas supply source 53 and the communication portion of the pipe 43*a* and the pipe 43*c*. The valve 43*b* may be arranged upstream from the pressure sensor 43*e* in the supply passage. An actuator (not shown) is attached to each of the valves 43*b*, 43*d*. Each actuator is electrically connected to the processor 120. The respective actuators open and close the valves 43*b*, 43*d* based on signals input from the processor 120, and the inside of the tank 41 is pressurized or depressurized by the opening and closing. In the case of pressurization, the actuator of the valve 43*d* closes the valve 43*d*, and the actuator of the valve 43*b* adjusts the opening degree of the valve 43*b*. In the case of depressurization, the actuator of the valve 43*b* closes the valve 43*b*, and the actuator of the valve 43*d* adjusts the opening degree of the valve 43*d*. The pressure-increasing speed of the pressure in the tank 41 due to the pressurization is adjusted by the opening degree of the valve 43*b*, and the pressure-decreasing speed of the pressure in the tank 41 due to the depressurization is adjusted by the opening degree of the valve 43*d*. Here, the inside of the tank 41 may be pressurized by opening the valve 43*b* larger than the valve 43*d*, and the inside of the tank 41 may be depressurized by opening the valve 43*d* larger than the valve 43*b*. The configuration of the pressure adjuster 43 is not particularly limited as long as the inside of the tank 41 is pressurized by supplying the inert gas from the gas supply source 53 and the inside of the tank 41 is depressurized by exhausting the inert gas from the inside of the tank 41. Therefore, in the pressure adjuster 43, instead of the valves 43*b*, 43*d*, a three way valve may be arranged at the communication portion of the pipe 43*a* and the pipe 43*c*.

The pressure sensor 43*e* measures the pressure in the tank 41 through the pipe 43*a*. The pressure sensor 43*e* is electrically connected to the processor 120. Here, the pressure sensor 43*e* may be arranged in the tank 41.

Returning to FIG. 3, the description of the chamber device 10 will be continued. The chamber device 10 includes a target collection unit 14. The target collection unit 14 is a box body attached to the inner wall 10*b* of the chamber device 10. The target collection unit 14 communicates with the internal space of the chamber device 10 through an opening 10*a* continued to the inner wall 10*b* of the chamber device 10. The target collection unit 14 and the opening 10*a* are arranged directly below the nozzle 42. The target collection unit 14 is a drain tank to collect any unnecessary droplet DL passing through the opening 10*a* and reaching the target collection unit 14 and to accumulate the unnecessary droplet DL.

At least one through hole is formed in the inner wall 10*b* of the chamber device 10. The through hole is blocked by a window 12 through which pulse laser light 90 emitted from the laser device LD passes.

Further, a laser light concentrating optical system 13 is located at the internal space of the chamber device 10. The laser light concentrating optical system 13 includes a laser light concentrating mirror 13A and a high reflection mirror 13B. The laser light concentrating mirror 13A reflects and concentrates the laser light 90 passing through the window 12. The high reflection mirror 13B reflects light concentrated by the laser light concentrating mirror 13A. Positions of the laser light concentrating mirror 13A and the high reflection mirror 13B are adjusted by a laser light manipulator 13C so that a concentrating position of the laser light 90 at the internal space of the chamber device 10 coincides with a position specified by the processor 120. The concentrating position is adjusted to be located directly below the nozzle 42, and when the target substance constituting the droplet DL is irradiated with the laser light at the concentrating position, plasma is generated by the irradiation, and the EUV light 101 is radiated from the plasma. In the following, the region in which plasma is generated is sometimes referred to as a plasma generation region AR.

For example, an EUV light concentrating mirror 75 having a spheroidal reflection surface 75*a* is arranged at the internal space of the chamber device 10. The reflection surface 75*a* reflects the EUV light 101 radiated from the plasma in the plasma generation region AR. The reflection surface 75*a* has a first focal point and a second focal point. The reflection surface 75*a* may be arranged such that, for example, the first focal point is located in the plasma generation region AR and the second focal point is located at an intermediate focal point IF. In FIG. 3, a straight line passing through the first focal point and the second focal point is shown as a focal line L0.

Further, the EUV light generation apparatus 100 includes a connection portion 19 providing communication between the internal space of the chamber device 10 and an internal space of the exposure apparatus 200. A wall in which an aperture is formed is arranged inside the connection portion 19. The wall is preferably arranged such that the aperture is located at the second focal point. The connection portion 19 is an emission port of the EUV light 101 in the EUV light generation apparatus 100, and the EUV light 101 is emitted from the connection portion 19 and enters the exposure apparatus 200.

Further, the EUV light generation apparatus 100 includes a pressure sensor 26 and a target sensor 27. The pressure sensor 26 and the target sensor 27 are attached to the chamber device 10 and are electrically connected to the processor 120. The pressure sensor 26 measures the pressure at the internal space of the chamber device 10. The target sensor 27 has, for example, an imaging function, and detects the presence, trajectory, position, velocity, and the like of the droplet DL output from the nozzle hole of the nozzle 42 according to an instruction from the processor 120. The target sensor 27 may be arranged inside the chamber device 10, or may be arranged outside the chamber device 10 and detect the droplet DL through a window (not shown) arranged on a wall of the chamber device 10. The target sensor 27 includes a light receiving optical system (not shown) and an imaging unit (not shown) such as a charge-coupled device (CCD) or a photodiode. In order to improve the detection accuracy of the droplet DL, the light-receiving optical system forms an image of the trajectory of the droplet DL and the periphery thereof on a light receiving surface of the imaging unit. When the droplet DL passes through a concentrating region of a light source unit (not shown) of the target sensor 27 arranged to secure the field of view of the target sensor 27, the imaging unit detects a change of the light passing through the trajectory of the droplet DL and the periphery thereof. The imaging unit converts the detected light change into an electric signal as a signal related to the image data of the droplet DL. The imaging unit outputs the electric signal to the processor 120.

The laser device LD includes a master oscillator being a light source to perform a burst operation. The master oscillator emits the pulse laser light 90 in a burst-on duration. The master oscillator is, for example, a laser device configured to emit the laser light 90 by exciting, through electric discharge, gas as mixture of carbon dioxide gas with helium, nitrogen, or the like. Alternatively, the master oscillator may be a quantum cascade laser device. The master oscillator may emit the pulse laser light 90 by a Q switch system. Further, the master oscillator may include an optical switch, a polarizer, and the like. In the burst operation, the pulse laser light 90 is continuously emitted at a predetermined repetition frequency in the burst-on duration and the emission of the laser light 90 is stopped in a burst-off duration.

The travel direction of the laser light 90 emitted from the laser device LD is adjusted by the laser light delivery optical system 30. The laser light delivery optical system 30 includes a plurality of mirrors 30A and 30B for adjusting a travel direction of the laser light 90. The position of at least one of the mirrors 30A and 30B is adjusted by an actuator (not shown). Owing to that the position of at least one of the mirrors 30A and 30B is adjusted, the laser light 90 can appropriately propagate to the internal space of the chamber device 10 through the window 12.

The processor 120 is a processing device including a storage device 120*a* in which a control program is stored and a CPU 120*b* which executes the control program. The processor 120 is specifically configured or programmed to perform various processes included in the present disclosure. The processor 120 controls several configurations of the EUV light generation apparatus 100. Further, the processor 120 controls the entire EUV light generation apparatus 100. The processor 120 receives a signal related to the pressure at the internal space of the chamber device 10, which is measured by the pressure sensor 26, a signal related to the image data of the droplet DL captured by the target sensor 27, a burst signal from the exposure apparatus 200, a signal related to the pressure in the tank 41 measured by the pressure sensor 43*e*, and the like. The processor 120 processes the various signals, and may control, for example, timing at which the droplet DL is output, an output direction of the droplet DL, and the like. Further, the processor 120 may control oscillation timing of the laser device LD, the travel direction of the laser light 90, the concentrating position of the laser light 90, and the like. Further, the processor 120 may control the opening and closing of the valves 43*b*, 43*d*, the opening degree of the valves 43*b*, 43*d*, and the like based on the signal from the pressure sensor 43*e*. Such various kinds of control described above are merely exemplary, and other control may be added as necessary, as described later.

A central gas supply unit 81 for supplying an etching gas to the internal space of the chamber device 10 is arranged at the chamber device 10. As described above, since the target substance contains tin, the etching gas is, for example, hydrogen-containing gas having a hydrogen gas concentration of 100% in effect. Alternatively, the etching gas may be, for example, a balance gas having a hydrogen gas concentration of about 3%. The balance gas contains nitrogen ($N_2$) gas and argon (Ar) gas. Tin fine particles and tin charged particles are generated when the target substance forming the droplet DL is turned into plasma in the plasma generation region AR by being irradiated with the laser light 90. Tin constituting these fine particles and charged particles reacts with hydrogen contained in the etching gas supplied to the internal space of the chamber device 10. Through the reaction with hydrogen, tin becomes stannane ($SnH_4$) gas at room temperature.

The central gas supply unit 81 has a shape of a side surface of a circular truncated cone and is called a cone in some cases. The central gas supply unit 81 is inserted through a through hole 75*c* formed in the center of the EUV light concentrating mirror 75.

The central gas supply unit 81 has a central gas supply port 81*a* being a nozzle. A central gas supply port 81*a* is arranged on the focal line L0 passing through the first focal point and the second focal point of the reflection surface 75*a*. The focal line L0 is extended along the center axis direction of the reflection surface 75*a*.

The central gas supply port 81*a* supplies the etching gas from the center side of the reflection surface 75*a* toward the plasma generation region AR. The central gas supply port 81*a* preferably supplies the etching gas in the direction away from the reflection surface 75*a* from the center side of the reflection surface 75*a* along the focal line L0. The central gas supply port 81*a* is connected to a gas supply device (not shown) being a tank through a pipe (not shown) of the central gas supply unit 81 and the etching gas is supplied therefrom. The gas supply device is driven and controlled by the processor 120. A supply gas flow rate adjusting unit being a valve (not shown) may be arranged in the pipe (not shown).

The central gas supply port 81*a* is a gas supply port for supplying the etching gas to the internal space of the chamber device 10 as well as an emission port through which the laser light 90 is emitted to the internal space of the chamber device 10. The laser light 90 travels toward the internal space of the chamber device 10 through the window 12 and the central gas supply port 81*a*.

An exhaust port 10E is continued to the inner wall 10*b* of the chamber device 10. Since the exposure apparatus 200 is arranged on the focal line L0, the exhaust port 10E is arranged not on the focal line L0 but on the inner wall 10*b* on the side lateral to the focal line L0. The direction along the center axis of the exhaust port 10E is perpendicular to the focal line L0. The exhaust port 10E is arranged on the side opposite to the reflection surface 75*a* with respect to the plasma generation region AR when viewed from the direction perpendicular to the focal line L0. The exhaust port 10E exhausts residual gas to be described later at the internal space of the chamber device 10. The exhaust port 10E is connected to an exhaust pipe 10P, and the exhaust pipe 10P is connected to an exhaust pump 60.

As described above, when the target substance is turned into plasma in the plasma generation region AR, the residual gas as exhaust gas is generated at the internal space of the chamber device 10. The residual gas contains tin fine particles and tin charged particles generated through the plasma generation from the target substance, stannane generated through the reaction of the tin fine particles and tin charged particles with the etching gas, and unreacted etching gas. Some of the charged particles are neutralized at the internal space of the chamber device 10, and the residual gas contains the neutralized charged particles as well. The residual gas is sucked to the exhaust pump 60 through the exhaust port 10E and the exhaust pipe 10*p*.

3.2 Operation

Next, operation of the EUV light generation apparatus 100 of the comparative example will be described. In the EUV light generation apparatus 100, for example, at the time of new installation or maintenance or the like, atmospheric air at the internal space of the chamber device 10 is exhausted. At this time, purging and exhausting of the internal space of the chamber device 10 may be repeated for exhausting atmospheric components. For example, inert gas such as nitrogen or argon is preferably used for the purge gas. Thereafter, when the pressure at the internal space of the chamber device 10 becomes equal to or lower than a predetermined pressure, the processor 120 starts introduction of the etching gas from the gas supply device to the internal space of the chamber device 10 through the central gas supply unit 81. At this time, the processor 120 may control the supply gas flow rate adjusting unit (not shown) and the exhaust pump 60 so that the pressure at the internal space of the chamber device 10 is maintained at a predetermined pressure. Thereafter, the processor 120 waits until a predetermined time elapses from the start of introduction of the etching gas.

Further, the processor 120 causes the gas at the internal space of the chamber device 10 to be exhausted from the exhaust port 10E by the exhaust pump 60, and keeps the pressure at the internal space of the chamber device 10 substantially constant based on the signal of the pressure at the internal space of the chamber device 10 measured by the pressure sensor 26.

In order to heat and maintain the target substance in the tank 41 at a predetermined temperature equal to or higher than the melting point, the processor 120 causes the heater power source 46 to apply current to the heater 44 to increase temperature of the heater 44. In this case, the processor 120 controls the temperature of the target substance to the predetermined temperature by adjusting a value of the current applied from the heater power source 46 to the heater 44 based on an output from the temperature sensor 45. When the target substance is tin, the predetermined temperature is equal to or higher than 231.93° C. being the melting point of tin, for example, 240° C. or higher and 290° C. or lower.

Further, the processor 120 causes the pressure adjuster 43 to supply the inert gas from the gas supply source 53 to the tank 41 and to adjust the pressure in the tank 41 so that the melted target substance is output through the nozzle hole of the nozzle 42 at a predetermined velocity. Under this pressure, the target substance is output through the nozzle hole of the nozzle 42 after particles are removed by the filter 51*a*. The target substance output through the nozzle hole may be in the form of jet. At this time, the processor 120 causes the piezoelectric power source 48 to apply a voltage having a predetermined waveform to the piezoelectric element 47 to generate the droplet DL. The piezoelectric power source 48 applies a voltage so that the waveform of the voltage value becomes, for example, a sine wave, a rectangular wave, or a sawtooth wave. Vibration of the piezoelectric element 47 can propagate through the nozzle 42 to the target substance to be output through the nozzle hole of the nozzle 42. The target substance is divided at a predetermined cycle by the vibration to be liquid droplets DL.

The target sensor 27 detects passage timing of the droplet DL passing through a predetermined position at the internal space of the chamber device 10. The processor 120 outputs, to the laser device LD, a light emission trigger signal synchronized with the signal from the target sensor 27. When the light emission trigger signal is input, the laser device LD emits the pulse laser light 90. The emitted laser light 90 is incident on the laser light concentrating optical system 13 through the laser light delivery optical system 30 and the window 12. Further, the laser light 90 travels from the laser light concentrating optical system 13 to the central gas supply unit 81 which is an emission portion. The laser light 90 is emitted along the focal line L0 toward the plasma generation region AR from the central gas supply port 81*a*, which is the emission port of the central gas supply unit 81, and is radiated to the droplet DL in the plasma generation region AR. At this time, the processor 120 controls the laser light manipulator 13C of the laser light concentrating optical system 13 so that the laser light 90 is concentrated in the plasma generation region AR. The processor 120 controls the timing of emitting the laser light 90 from the laser device LD based on the signal from the target sensor 27 so that the droplet DL is irradiated with the laser light 90. Thus, the droplet DL is irradiated in the plasma generation region AR with the laser light 90 concentrated by the laser light concentrating mirror 13A. Light including EUV light is emitted from the plasma generated through the irradiation.

Among the light including the EUV light generated in the plasma generation region AR, the EUV light 101 is concentrated at the intermediate focal point IF by the EUV light concentrating mirror 75, and then is incident on the exposure apparatus 200 from the connection portion 19.

When the target substance is turned into plasma, tin fine particles are generated as described above. The fine particles diffuse to the internal space of the chamber device 10. The fine particles diffusing to the internal space of the chamber device 10 react with the hydrogen-containing etching gas supplied from the central gas supply unit 81 to become stannane. Most of the stannane obtained through the reaction with the etching gas flows into the exhaust port 10E along with the flow of the unreacted etching gas. At least some of the unreacted charged particles, fine particles, and etching gas flow into the exhaust port 10E.

The unreacted etching gas, fine particles, charged particles, stannane, and the like having flowed into the exhaust port 10E flow as residual gas through the exhaust pipe 10P into the exhaust pump 60 and are subjected to predetermined exhaust treatment such as detoxification.

Figure 5:
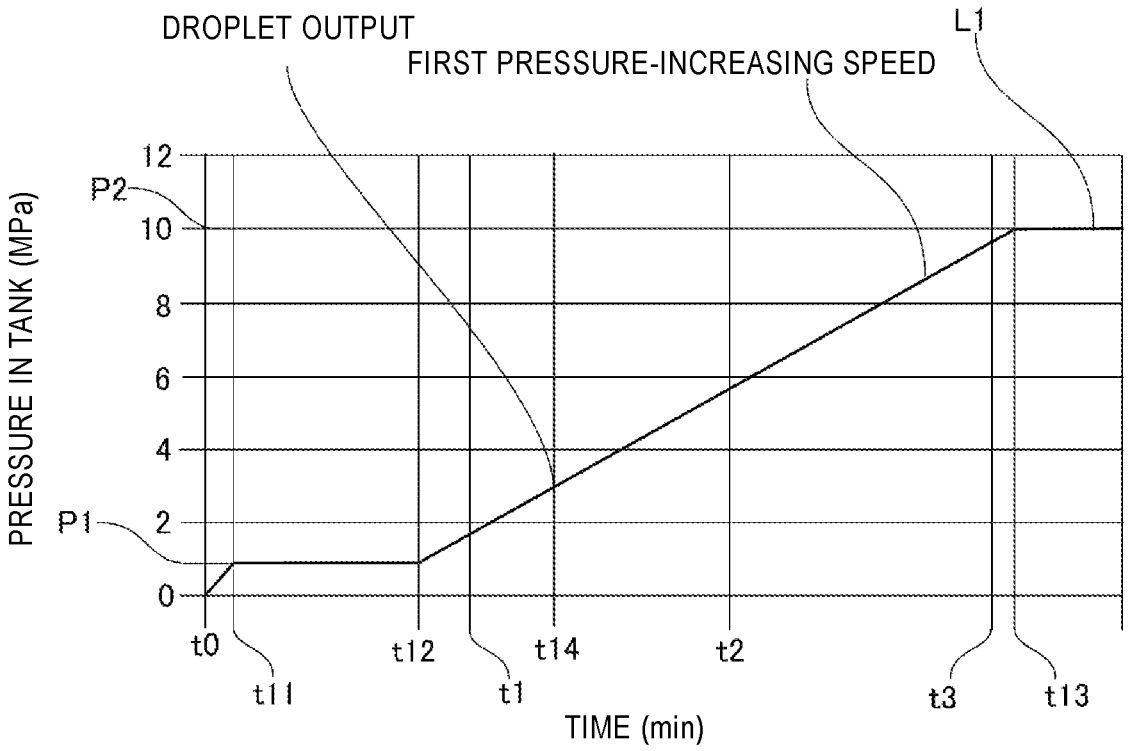
FIG. 5 is a graph showing the relationship between the pressure in a tank and time at which the pressure increases in a comparative example.

In the EUV light generation apparatus 100 of the comparative example, the processor 120 pressurizes the inside of the tank 41 by the pressure adjuster 43 and outputs the droplet DL in the following procedure. FIG. 5 is a graph showing the relationship between the pressure in the tank 41 and time at which the pressure increases. In the following, the pressure in the tank 41 may be referred to as a pressure P. A solid line L1 shown in FIG. 5 indicates a change of the pressure value measured by the pressure sensor 43*e*, that is, a change of the pressure P with time. In the following, the time means the time from the start of pressurization. Time t0, t1, t2, and t3 shown in FIG. 5 denote 0, 10, 20, and 30 minutes.

At the start time of pressurization, time t0, the heater 44 is already heating the tank 41 by the current supplied by the heater power source 46, and the target substance in the tank 41 is melted. Further, the valves 43*b*, 43*d* are in a closed state.

At time t0, the processor 120 outputs a signal to the actuator of the valve 43*b*, and controls the opening degree of the valve 43*b* via the actuator so that the pressure P increases to a predetermined pressure P1 at a predetermined pressure-increasing speed. The predetermined pressure-increasing speed is a speed at which the pressure P at time t11 becomes the predetermined pressure P1. When the valve 43*b* is opened, the inert gas is supplied from the gas supply source 53 into the tank 41 through the pipe 43*a*. Thus, the pressure adjuster 43 pressurizes the inside of the tank 41 to the predetermined pressure P1 at the predetermined increasing speed until time t11. For example, time t11 is 1 minute, and the predetermined pressure P1 is 1 MPa. The processor 120 receives a signal related to the pressure P measured by the pressure sensor 43*e*. Therefore, when the processor 120 controls the valve 43*b*, the processor 120 performs feedback control based on the signal from the pressure sensor 43*e* so that the pressure P becomes the predetermined pressure P1. Thus, at time t11, the pressure P is increased to the predetermined pressure P1.

When the signal indicating that the pressure P is at the predetermined pressure P1 is input from the pressure sensor 43*e* to the processor 120, the processor 120 outputs a signal to the actuator of the valve 43*b* and controls the valve 43*b* to remain opened via the actuator from time t11 to time t12. Thus, the pressure P remains at the predetermined pressure P1 from time t11 to time t12. For example, time t12 is 8 minutes. From time t0 to time t12, the target substance in the tank 41 permeates into the filter 51*a* in the tank 41 by the pressure increase, and is filled in the space from the filter 51*a* to the nozzle hole. Further, the processor 120 controls the opening degree of the valve 43*b* by the above-described feedback control. Accordingly, decrease in the pressure P is suppressed.

At time t12, the processor 120 outputs a signal to the actuator of the valve 43*b* and controls the opening degree of the valve 43*b* via the actuator so that the pressure P is increased at a first pressure-increasing speed from the predetermined pressure P1 to a first target pressure P2. The first predetermined pressure-increasing speed is a speed at which the pressure P at time t13 becomes the first target pressure P2. When the valve 43*b* is opened again, the inert gas is supplied again from the gas supply source 53 into the tank 41 through the pipe 43*a*. Thus, the pressure adjuster 43 pressurizes the inside of the tank 41 from time t12 to time t13 to the first target pressure P2 at the first pressure-increasing speed. For example, the first target pressure P2 is 10 MPa, and time t13 is 32 minutes. The first pressure-increasing speed is adjusted with the opening degree of the valve 43*b*. The opening degree is controlled by the processor 120 based on the signal from the pressure sensor 43*e*. Thus, at time t13, the pressure P is increased to the first target pressure P2.

When the signal indicating that the pressure P is the first target pressure P2 is input from the pressure sensor 43*e* to the processor 120, the processor 120 controls the opening degree of the valve 43*b* by the feedback control described above. As a result, decrease in the pressure P is suppressed, and the pressure P remains at the first target pressure P2. After time t13 at which the pressure P becomes the first target pressure P2, the target supply device 40 maintains the first target pressure P2.

When the pressure P increasing at the first pressure-increasing speed after time t12 is equal to or higher than a certain pressure, the target substance is output from the nozzle hole of the nozzle 42 due to pressurization by the pressure. The piezoelectric element 47 is driven from time t0 and vibration of the piezoelectric element 47 can propagate through the nozzle 42 to the target substance to be output from the nozzle hole of the nozzle 42. Accordingly, the target substance is divided at a predetermined cycle by the vibration, and output from the nozzle hole of the nozzle 42 as liquid droplets DL. In FIG. 5, the time at which the droplet DL is output is defined as time t14 between time t12 and time t13. Therefore, the droplet DL is not output from time t0 to time t14, time t14 is the output start time of the droplet DL, and the droplet DL continues to be output after time t14. For example, time t14 is 13 minutes. The output droplet DL travels toward the plasma generation region AR. The trajectory of the droplet DL tends to be along the center axis of the circular nozzle hole.

3.3 Problem

Figure 6:
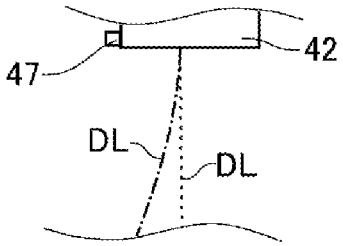
FIG. 6 is a view showing an example in which a droplet output from a nozzle is in an unstable state.
Figure 7:
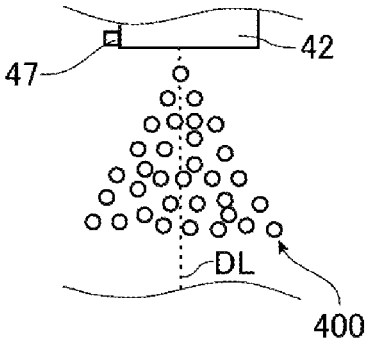
FIG. 7 is a view showing another example in which the droplet output from the nozzle is in an unstable state.

In the target supply device 40 of the comparative example, the pressure-increasing speed remains the same as the first pressure-increasing speed before and after the outputting of the droplet DL. When the pressure P in the tank 41 is increased at the first pressure-increasing speed from time t14 to time t13, the droplet DL output from the nozzle hole may be in an unstable state. As an unstable state, as shown in FIG. 6, the trajectory of the droplet DL deviates from the stable state along the center axis of the nozzle hole as shown by a broken line, and deviates from the stable state as shown by a dotted chain line as the droplet DL travels. Alternatively, as shown in FIG. 7, the droplet DL may be sprayed from the nozzle hole and scattered as fine splashes 400. Although the shape of the splashes 400 is shown as a circle, the shape is not particularly limited. In FIG. 7, the trajectory of the droplet DL in the stable state is also shown by a broken line.

The unstable state does not always continue to occur after time t14, but tends to be gradually resolved over time. Therefore, in the process after the droplet DL is output at time t14, the deviation of the trajectory of the droplet DL shown in FIG. 6 and the scattering of the droplet DL shown in FIG. 7 are gradually eliminated, and the droplet DL tends to shift from the unstable state to the stable state in which the trajectory of the droplet DL is along the center axis of the nozzle hole. In view of the above, it is presumed that the unstable state occurs during a predetermined time from time t14.

In the unstable state, as described above, the trajectory of the droplet DL deviates from the center axis of the nozzle hole, or the droplet DL scatters. As a result, the droplet DL may adhere to and contaminate the reflection surface 75*a* of the EUV light concentrating mirror 75 and the window (not shown) of the target sensor 27. Accordingly, the reflectivity of the reflection surface 75*a* may decrease, or the detection sensitivity of the target sensor 27 may decrease. Such contamination of the structural components at the internal space of the chamber device 10 may cause failure of the chamber device 10. Here, the longer the time during which the droplet DL is in the unstable state, the more the contamination may spread.

Therefore, in the following embodiments, the target supply device 40 capable of suppressing failure of the EUV light generation apparatus 100 due to the unstable state of the droplet DL by shortening the time during which the droplet DL is in the unstable state is exemplified.

4. Description of Extreme Ultraviolet Light Generation Apparatus of First Embodiment Next, the configuration of the EUV light generation apparatus 100 of a first embodiment will be described. Any component same as that described above is denoted by an identical reference sign, and duplicate description thereof is omitted unless specific description is needed.

4.1 Configuration

The configuration of the EUV light generation apparatus 100 of the present embodiment is the same as the configuration of the EUV light generation apparatus 100 of the comparative embodiment, and therefore description thereof is omitted.

4.2 Operation

Next, operation of the processor 120 for controlling the pressure P in the tank 41 in the present embodiment will be described.

Figure 8:
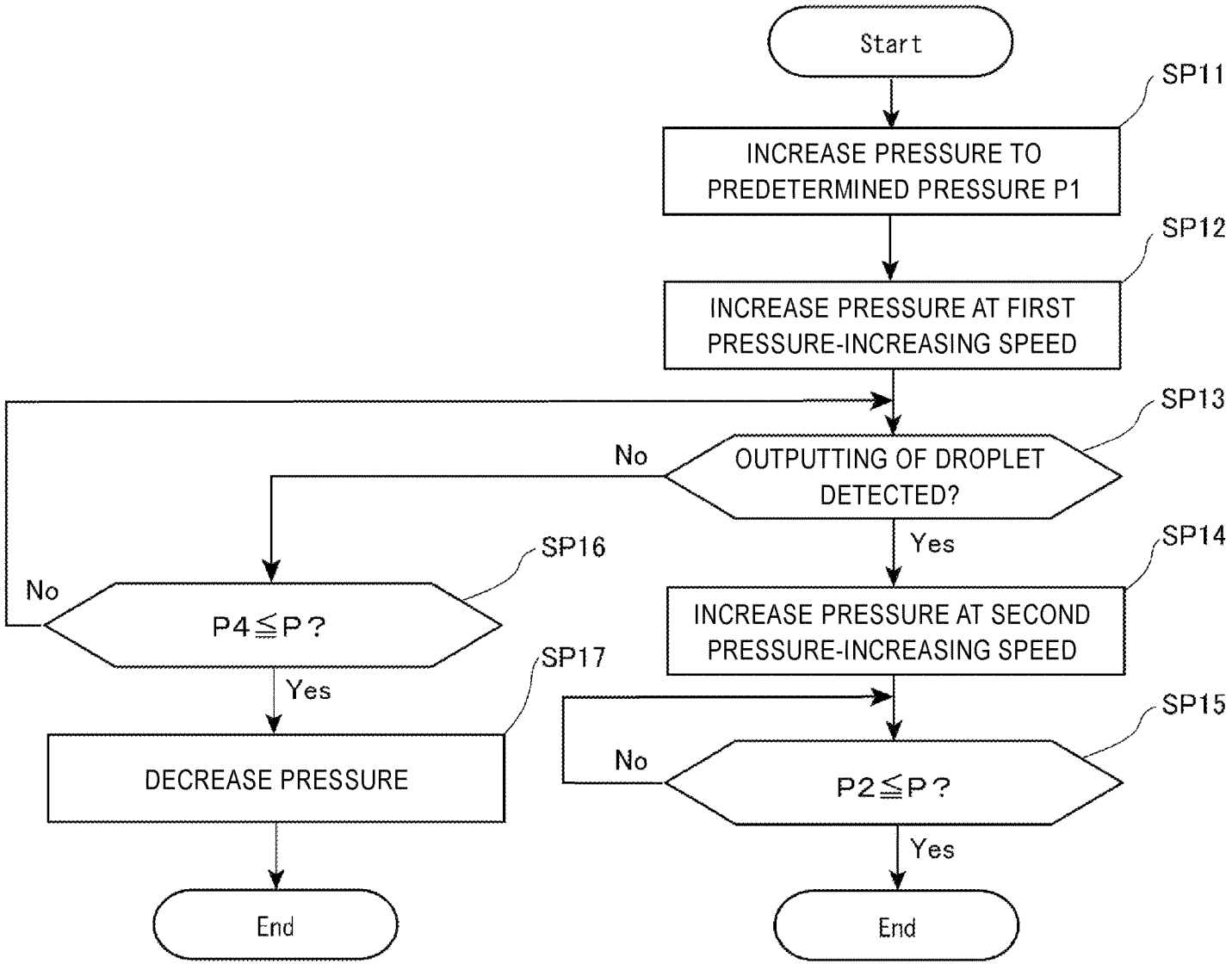
FIG. 8 is a diagram showing an example of a control flowchart of a processor according to a first embodiment.

FIG. 8 is a diagram showing an example of a control flowchart of the processor 120 according to the present embodiment. As shown in FIG. 8, the control flow of the present embodiment includes steps SP11 to SP17. The control flow of the present embodiment is used when the target supply device 40 is installed in the EUV light generation apparatus 100 for the first time, the target substance is filled in the tank 41 for the first time in the EUV light generation apparatus 100 and permeates the filter 51*a*, and the nozzle 42 outputs the droplet DL for the first time after the installation of the target supply device 40.

Figure 9:
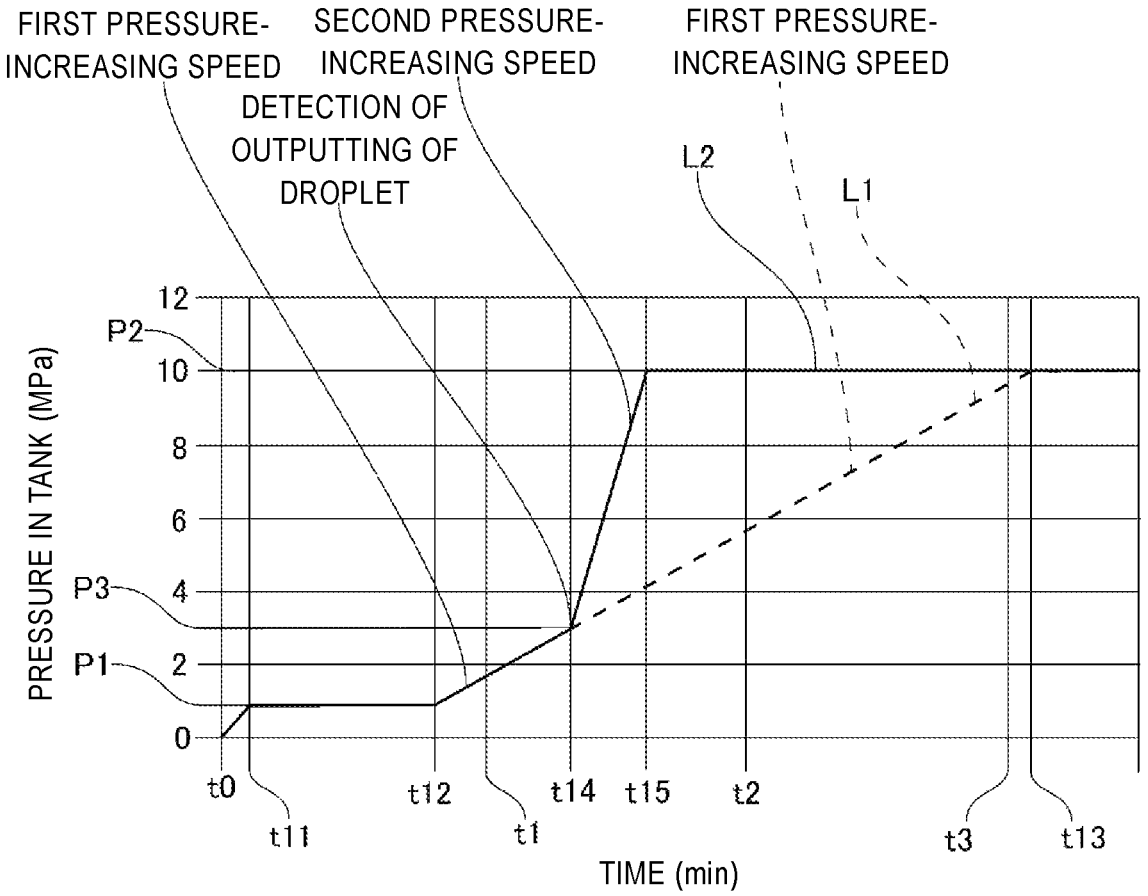
FIG. 9 is a diagram showing the relationship between the pressure in the tank and time at which the pressure increases in the tank in the first embodiment.

FIG. 9 is a diagram showing the relationship between the pressure P in steps SP11 to SP15 and the time at which the pressure increases. A solid line L2 shown in FIG. 9 indicates a change of the pressure P in steps SP11 to SP15. In FIG. 9, in order to compare the present embodiment with the comparative example, the change of the pressure P indicated by the solid line L1 in FIG. 5 is shown by a broken line L1.

The state at start shown in FIG. 8 is the same as that at time t0 in the comparative example. Further, in the state at start of the present embodiment, a signal is input from the target sensor 27 to the processor 120.

(Step SP11)

In this step, the processor 120 controls the pressure adjuster 43 so that the change of the pressure P from time t0 to time t12 is the same as that in the comparative example.

Therefore, the pressure P becomes the predetermined pressure P1 by being increased from time t0 to time t11, and remains at the predetermined pressure P1 from time t11 to time t12. After the processor 120 controls the pressure adjuster 43 as described above, the control flow proceeds to step SP12.

(Step SP12)

In this step, at time t12, similarly to the comparative example, the processor 120 outputs a signal to the actuator of the valve 43*b* and controls the opening degree of the valve 43*b* via the actuator so that the pressure P is increased at a first pressure-increasing speed from the predetermined pressure P1 to the first target pressure P2. Therefore, the pressure adjuster 43 pressurizes the inside of the tank 41 from time t12 at the first pressure-increasing speed. In the target supply device 40 of the present embodiment, it is preferable that the first pressure-increasing speed is approximately 0.002 MPa/s or higher and 0.0067 MPa/s or lower, but may be lower than 0.002 MPa/s. The first pressure-increasing speed is stored in the storage device 120*a* in advance, and the processor 120 may read out the first pressure-increasing speed from the storage device 120*a*. When the first pressure-increasing speed is 0.002 Mpa/s or higher and 0.0067 MPa/s or lower, generation of bubbles in the target substance in the tank 41 is suppressed, and due to the suppression, generation of particles in the target substance in the tank 41 is suppressed. Further, when the generation of particles is suppressed, clogging of the nozzle hole due to the particles that have passed through the filter 51*a* is suppressed. After the processor 120 controls the pressure adjuster 43 as described above, the control flow proceeds to step SP13.

(Step SP13)

In this step, when a signal indicating detection of outputting of the droplet DL is input from the target sensor 27 to the processor 120, the processor 120 advances the control flow to step SP14. At time t14, when the droplet DL is output for the first time after the installation of the target supply device 40, in the target supply device 40 of the present embodiment, the droplet DL is detected for the first time by the target sensor 27. The detection region of the target sensor 27 is located directly below the nozzle hole, and the target sensor 27 is a droplet detector that detects the droplet DL by imaging the droplet DL immediately after output according to an instruction from the processor 120. Therefore, time t14 can be regarded as the time when the target sensor 27 has detected the droplet DL for the first time after the installation of the target supply device 40. In FIG. 5, the pressure in the tank 41 at time t14 is set as a pressure P3, so that the droplet DL is output for the first time at the pressure P3 and the droplet DL continues to be output at the pressure P3 or higher. For example, the pressure P3 is 3 MPa.

Further, in this step, when a signal not indicating the detection of outputting of the droplet DL is input to the processor 120 from the target sensor 27, the processor 120 advances the control flow to step SP16. Since the droplet DL is not output from time t12 to time t14, the processor 120 advances the control flow to step SP16 in a period from time t12 to time t14. Here, the droplet DL is a liquid droplet, and the liquid droplets are output at intervals. The interval is approximately 0.5 mm or more and 1 mm or less. When the droplet DL enters the detection region of the target sensor 27 which is sufficiently larger than the interval, the target sensor 27 detects at least one droplet DL. Therefore, the state in which the target sensor 27 does not detect the droplet DL indicates the state before the droplet DL is output from the nozzle hole or before the output droplet DL enters the detection region of the target sensor 27.

(Step SP14)

In this step, the processor 120 outputs a signal to the actuator of the valve 43*b* and controls the opening degree of the valve 43*b* via the actuator so that the pressure P is increased at a second pressure-increasing speed after time t14 to the first target pressure P2 from the pressure P3 at time t14. Therefore, the pressure adjuster 43 pressurizes the inside of the tank 41 from time t14 at the second pressure-increasing speed. The second pressure-increasing speed being higher than the first pressure-increasing speed is a speed at which the pressure P becomes the first target pressure P2 at time t15 earlier than time t13. It is preferable that the second pressure-increasing speed is approximately 0.2 MPa/s or higher and 1 Mpa/s or lower, but may exceed 1 MPa/s. The second pressure-increasing speed is stored in the storage device 120*a* in advance, and the processor 120 may read out the second pressure-increasing speed from the storage device 120*a*. For example, time t15 is 16 minutes. The processor 120 of the present embodiment increases the pressure-increasing speed of the pressure P to be higher than that before the detection of the outputting of the droplet DL after a predetermined time elapses since the signal indicating the detection of the outputting of the droplet DL is input from the target sensor 27 to the processor 120*g*. The predetermined time is approximately 1 ms or more and 1 s or less. Since the predetermined time is much shorter than the time during which the pressure P is increased at the first pressure-increasing speed and the second pressure-increasing speed, the timing of switching the pressure-increasing speed overlaps with time t14 in FIG. 9. As described above, since the predetermined time is very short and the pressure increase in the predetermined time is small, the pressure at which the pressure-increasing speed is switched in the present embodiment can be generally regarded as the pressure P3. As described above, in the target supply device 40 of the present embodiment, during the period in which the pressure P is increased to the first target pressure P2 from the pressure P3 at which the outputting of the droplet DL is detected by the target sensor 27 for the first time after the installation of the target supply device 40, the pressure-increasing speed of the pressure P becomes higher after the detection of the outputting of the droplet DL than before the detection of the outputting of the droplet DL, and the pressure P increases faster after the detection than before the detection.

The lower limit of the pressure P3 at time t14 at which the droplet DL is output for the first time depends on the conductance from the inlet of the filter 51*a* to the nozzle hole. The lower limit is generally 2.83 MPa, but varies depending on the target supply device 40. Therefore, it is preferable to adopt, as an index of the timing of switching the pressure-increasing speed, the detection of the outputting of the droplet DL as described above rather than the use of the lower limit value.

Next, the reason why the first pressure-increasing speed is adopted before the second pressure-increasing speed will be described.

A space is arranged between the filter 51*a* and the nozzle hole. If the second pressure-increasing speed is adopted without adopting the first pressure-increasing speed before the detection of the outputting of the droplet DL, the pressure P is increased fast compared to the case where the first pressure-increasing speed is adopted, and the target substance may vigorously enter the space. Due to this entering, part of the atmospheric air in the space is discharged from the nozzle hole, but the remaining part of the atmospheric air may enter the target substance as bubbles.

As a result, there is a concern that the droplet DL being output may become unstable. However, when the first pressure-increasing speed is adopted, the target substance enters the space more slowly than when the second pressure-increasing speed is adopted, permeates into the filter 51*a* in the tank 41, and is filled in the space from the filter 51*a* to the nozzle hole. As a result, the atmospheric air in the space is discharged from the nozzle hole, and the entering of the bubbles into the target substance is suppressed. Therefore, occurrence of the unstable state of the droplet DL is suppressed.

Further, if the second pressure-increasing speed is adopted without adopting the first pressure-increasing speed before the detection of the outputting of the droplet DL, the pressure P is increased fast compared to the case where the first pressure-increasing speed is adopted. The pressure increase causes a pressure difference between the upstream side and the downstream side of the filter 51*a*, and an impact may be suddenly applied to the filter 51*a* due to the pressure difference. However, when the first pressure-increasing speed is adopted, the occurrence of the pressure difference is suppressed, and the sudden impact to the filter 51*a* is suppressed.

After the processor 120 controls the pressure adjuster 43 as described above, the control flow proceeds to step SP15.

(Step SP15)

In this step, the processor 120 returns the control flow to step SP15 when the pressure P indicated by the signal input from the pressure sensor 43*e* is lower than the first target pressure P2. Thus, the pressure adjuster 43 pressurizes the inside of the tank 41 to the first target pressure P2 continuously at the second pressure-increasing speed. On the other hand, when the pressure P becomes the first target pressure P2, the processor 120 controls the opening degree of the valve 43*b* by the above-described feedback control. As a result, decrease in the pressure P is suppressed, and the pressure P remains at the first target pressure P2. After time t15 at which the pressure P becomes the first target pressure P2, the target supply device 40 maintains the first target pressure P2. After controlling the valve 43*b* as described above, the processor 120 ends the control flow.

(Step SP16)

In this step, the processor 120 returns the control flow to step SP13 when the pressure P indicated by the signal input from the pressure sensor 43*e* is lower than the second target pressure P4. The second target pressure P4 is higher than the pressure P3 that is assumed when the outputting of the droplet DL is detected by the target sensor 27 for the first time after the installation of the target supply device 40, and is equal to or lower than the first target pressure P2. The second target pressure P4 is, for example, 5 MPa. The second target pressure P4 is stored in the storage device 120*a*, and the processor 120 reads out the second target pressure P4. When the droplet DL is not output even when the pressure P becomes equal to or higher than the second target pressure P4, it is assumed that, for example, the nozzle hole is clogged with particles.

In this step, the processor 120 advances the control flow to step SP17 when the pressure P indicated by the signal input from the pressure sensor 43*e* is the second target pressure P4 or higher.

(Step SP17)

In this step, the processor 120 outputs a signal to the actuator of the valve 43*b* and closes the valve 43*b* via the actuator. The processor 120 also outputs a signal to the actuator of the valve 43*d* and controls the opening degree of the valve 43*d* via the actuator so that the pressure P is decreased. When the valve 43*b* is closed, supply of the inert gas from the gas supply source 53 through the pipe 43*a* into the tank 41 is stopped. Further, when the valve 43*d* is opened, the inert gas in the tank 41 is exhausted through the pipes 43*a*, 43*c*. Thus, the pressure adjuster 43 depressurizes the inside of the tank 41. For example, if the pressure P becomes equal to or higher than the second target pressure P4 in a state in which the droplet DL is not output due to clogging of the nozzle hole with particles or the like, there is a concern that the target supply device 40 has operation failure. In this case, there is a possibility that the clogging of the nozzle hole is solved only by an overhaul. As another possibility, the droplet DL is pushed out from the nozzle hole together with particles by the pressure P equal to or higher than the second target pressure P4 and is output together with the particles, but there is a possibility that the droplet DL is scattered. When the droplet DL is scattered, there is a concern that structural components at the internal space of the chamber device 10 are contaminated. In either case, it is not preferable to set the pressure P to be equal to or higher than the second target pressure P4 in the state in which the droplet DL is not output. Therefore, in this step, the processor 120 controls the opening degree of the valve 43*d* via the actuator of the valve 43*d* so that the pressure P is decreased to be lower than the pressure P3 that is assumed when the outputting of the droplet DL is detected by the target sensor 27 for the first time after the installation of the target supply device 40. The pressure P3 is stored in the storage device 120*a*, and the processor 120 reads out the pressure P3. Thus, the pressure-increasing operation is stopped. After the processor 120 controls the pressure adjuster 43 as described above, the control flow ends.

4.3 Effect

The target supply device 40 of the present embodiment includes the tank 41 for storing the target substance, the pressure adjuster 43 for adjusting the pressure P inside the tank 41, the filter 51*a* for filtering the target substance in the tank 41, and the nozzle 42 for outputting the droplet DL of the target substance having passed through the filter 51*a*. The target supply device 40 includes the target sensor 27 that detects the outputting of the droplet DL from the nozzle 42, and the processor 120 that controls the pressure adjuster 43 so that the pressure-increasing speed of the pressure P is higher after the detection of the outputting of the droplet DL than before the detection of the outputting of the droplet DL during the period in which the pressure P is increased to the first target pressure P2 from the pressure P3 at which the outputting of the droplet DL is detected by the target sensor 27 for the first time after the installation of the target supply device 40.

With the above-described configuration, the pressure P is increased faster after the detection of the outputting of the droplet DL than before the detection of the outputting of the droplet DL, as compared with the case where the pressure-increasing speed is the same before and after the detection of the outputting of the droplet DL or the case where the pressure-increasing speed is lower after the detection of the outputting of the droplet DL than before the detection of the outputting of the droplet DL. When the pressure P is increased fast, the droplet DL is vigorously output from the nozzle hole, the trajectory of the droplet DL is along the center axis of the nozzle hole, and the time during which the droplet DL is in the unstable state may be shortened. When the unstable time is short, contamination of the structural components at the internal space of the chamber device 10 can be suppressed, and occurrence of the failure of the chamber device 10 can be suppressed.

It is considered that the unstable state is caused by the wet state or the like of the target substance at the edge of the nozzle hole, but it is difficult to predict the occurrence of the unstable state. Therefore, as described above, the target sensor 27 detects the outputting of the droplet DL from the nozzle 42, and the pressure-increasing speed is switched after the detection, so that the prediction may be unnecessary.

Even if the first pressure-increasing speed is adopted by the time immediately before the detection of the outputting of the droplet DL, the atmospheric air in the space from the filter 51*a* to the nozzle hole may enter the target substance as bubbles, and the trajectory of the droplet DL to be output may be disturbed by the bubbles. In particular, when the droplet DL is output by the pressure P which is increased at the second pressure-increasing speed in a state where the bubbles enter the target substance, there is a concern that the trajectory of the droplet DL to be output is greatly disturbed and the contamination of the structural components at the internal space of the chamber device 10 spreads as compared with a case where the bubbles do not enter the target substance. However, in the target supply device 40 of the present embodiment, the processor 120 sets the pressure-increasing speed of the pressure P to be higher than that before the detection of the outputting of the droplet DL after the elapse of the predetermined time from the detection of the outputting of the droplet DL by the target sensor 27 for the first time after the installation of the target supply device 40. Owing to that the predetermined period is secured, the atmospheric air in the space is discharged from the nozzle hole, and the entering of the bubbles into the target substance is suppressed. When the entering is suppressed, even in a case where the droplet DL is output by the pressure P which is increased at the second pressure-increasing speed, the disturbance of the trajectory can be suppressed, and the spread of the contamination of the structural components at the internal space of the chamber device 10 can be suppressed.

Further, in the target supply device 40 of the present embodiment, the processor 120 controls the pressure adjuster 43 so that the pressure P is decreased in a case where the outputting of the droplet DL is not detected by the target sensor 27 and the pressure P is equal to or higher than the second target pressure P4. When the pressure P becomes equal to or higher than the second target pressure P4 while the droplet DL is not output, there is a concern that the target supply device 40 has operation failure. However, in the target supply device 40 of the present embodiment, with the above-described configuration, the pressure-increasing operation is stopped, and the occurrence of the operation failure of the chamber device 10 can be suppressed.

Further, in the target supply device 40 of the present embodiment, the processor 120 controls the pressure adjuster 43 so that the pressure P is decreased to be lower than the pressure P3 that is assumed when the outputting of the droplet DL is detected by the target sensor 27 for the first time after the installation of the target supply device 40. With this configuration, it is possible to further suppress the occurrence of the operation failure of the chamber device 10.

In the target supply device 40 of the present embodiment, as described above, the processor 120 switches the pressure-increase speed after a predetermined time elapses since the signal indicating the detection of the outputting of the droplet DL by the target sensor 27 for the first time after the installation of the target supply device 40 is input from the target sensor 27 to the processor 120, but it is not limited thereto.

The switching timing will be described below.

In the target supply device 40 of the present embodiment, the processor 120 may increase the pressure-increasing speed of the pressure P to be higher than that before the detection of the outputting of the droplet DL until the pressure P is increased from the pressure P3 to approximately 90% of the first target pressure P2 at the latest. With this configuration as well, the time during which the droplet DL is in the unstable state can be shorter than in the case where the pressure P is increased to the first target pressure P2 at the first pressure-increasing speed. Here, the pressure at which the pressure-increasing speed is switched is set to 90% of the first target pressure P2, but the numerical value is not particularly limited.

Alternatively, in the target supply device 40 of the present embodiment, the processor 120 may increase the pressure-increasing speed of the pressure P to be higher than that before the detection of the outputting of the droplet DL until the pressure P is increased from the pressure P3 to approximately 130% of the pressure P3 at the latest. With this configuration as well, the time during which the droplet DL is in the unstable state can be shorter than in the case where the pressure P is increased to the first target pressure P2 at the first pressure-increasing speed. The processor 120 may increase the pressure-increasing speed of the pressure P higher than that before the detection of the outputting of the droplet DL when the pressure P is increased to a pressure equal to or higher than approximately 130% of the pressure P3. In the above, the pressure at which the pressure-increasing speed is switched is set to 130% of the pressure P3, but the numerical value is not particularly limited.

The pressure at which the pressure increasing speed is switched may be 100% or higher of the pressure P3 and lower than 100% of the first target pressure P2. Therefore, the processor 120 may increase the pressure-increasing speed of the pressure P after detecting the outputting of the droplet DL than before detecting the outputting of the droplet DL, before the pressure P is increased to the first target pressure P2 from the pressure P3 at which the outputting of the droplet DL is detected by the target sensor 27 for the first time after the installation of the target supply device 40.

Further, in the target supply device 40 of the present embodiment, the speed at which the pressure in the tank 41 is increased from time t12 to time t14 is described as the first pressure-increasing speed, but it is not limited thereto. The first pressure-increasing speed may be the speed immediately before the outputting of the droplet DL is detected by the target sensor 27 for the first time after the installation of target supply device 40. Therefore, if the pressure P is gradually increased from time t0 to time t14, the pressure-increasing speed of the pressure P from time t0 to time t14 is the first pressure-increasing speed. Further, after time t15 at which the pressure P becomes the first target pressure P2, the target supply device 40 does not necessarily need to maintain the first target pressure P2.

Further, in the target supply device 40 of the present embodiment, the above-described control flow may be used when the nozzle 42 outputs the droplet DL for the first time after the installation of the target supply device 40 in order to check the output state of the target supply device 40, or may be used when the nozzle 42 outputs the droplet DL in order to generate the EUV light 101.

Further, in the target supply device 40 of the present embodiment, it is preferable that the imaging unit of the target sensor 27 images the droplet DL toward the travel direction of the droplet DL output from the nozzle hole or images the droplet DL toward the direction substantially perpendicular to the trajectory of the droplet DL rather than imaging the droplet DL toward the nozzle hole. The target sensor 27 including the imaging unit may further include a magnifying lens system, a laser curtain, and the like. The imaging unit may be configured to include an image sensor such as a CCD or a (CMOS), but may be configured to include a light receiving element such as a line sensor. The target sensor 27 as a droplet detector may include a non-contact proximity switch instead of the light receiving optical system and the imaging unit. Here, although the target sensor 27 is used as the droplet detector in the above description, a droplet detector may be arranged separately from the target sensor 27.

5. Description of Extreme Ultraviolet Light Generation Apparatus of Second Embodiment Next, the configuration of the EUV light generation apparatus 100 of a second embodiment will be described. Any component same as that described above is denoted by an identical reference sign, and duplicate description thereof is omitted unless specific description is needed.

5.1 Configuration

In the EUV light generation apparatus 100 of the present embodiment, the configuration of the storage device 120*a* differs from the configuration of the storage device 120*a* of the first embodiment.

The storage device 120*a* stores output information of the target supply device 40. The output information includes an output count after the installation of the target supply device 40. One output indicates that the pressure P in the tank 41 has reached the first target pressure P2 as described in step SP15 after the pressure increase at time t0. When the outputting of the droplet DL is performed once, the storage device 120*a* increments the current output count by one. If the output count is 0, the droplet DL is to be output for the first time after the installation of the target supply device 40, and if the output count is 1 or more, the droplet DL is to be re-output. The re-outputting of the droplet DL does not indicate a condition in which the target substance stored after the tank 41 is emptied is output. In the re-outputting of the droplet DL, before the tank 41 becomes empty, the pressure P is decreased to be lower than the pressure P3 after reaching the first target pressure P2 as described above, and is increased from the pressure lower than the pressure P3 to the pressure P3 or higher after the pressure decrease. Here, in the re-outputting of the droplet DL, before the tank 41 becomes empty, the pressure P may be increased to the pressure P3 or higher, then decreased to lower than the pressure P3, and then increased from the pressure lower than the pressure P3 to the pressure P3 or higher. The output information may include information indicating whether or not the droplet DL has been output in the past, instead of the output count. Further, in the output information, the installation date and time of the target supply device 40 to the chamber device 10 and the output start date and time by the pressure adjuster 43 into the tank 41 may be further stored.

5.2 Operation

Next, operation of the processor 120 for controlling the pressure P in the tank 41 in the present embodiment will be described.

Figure 10:
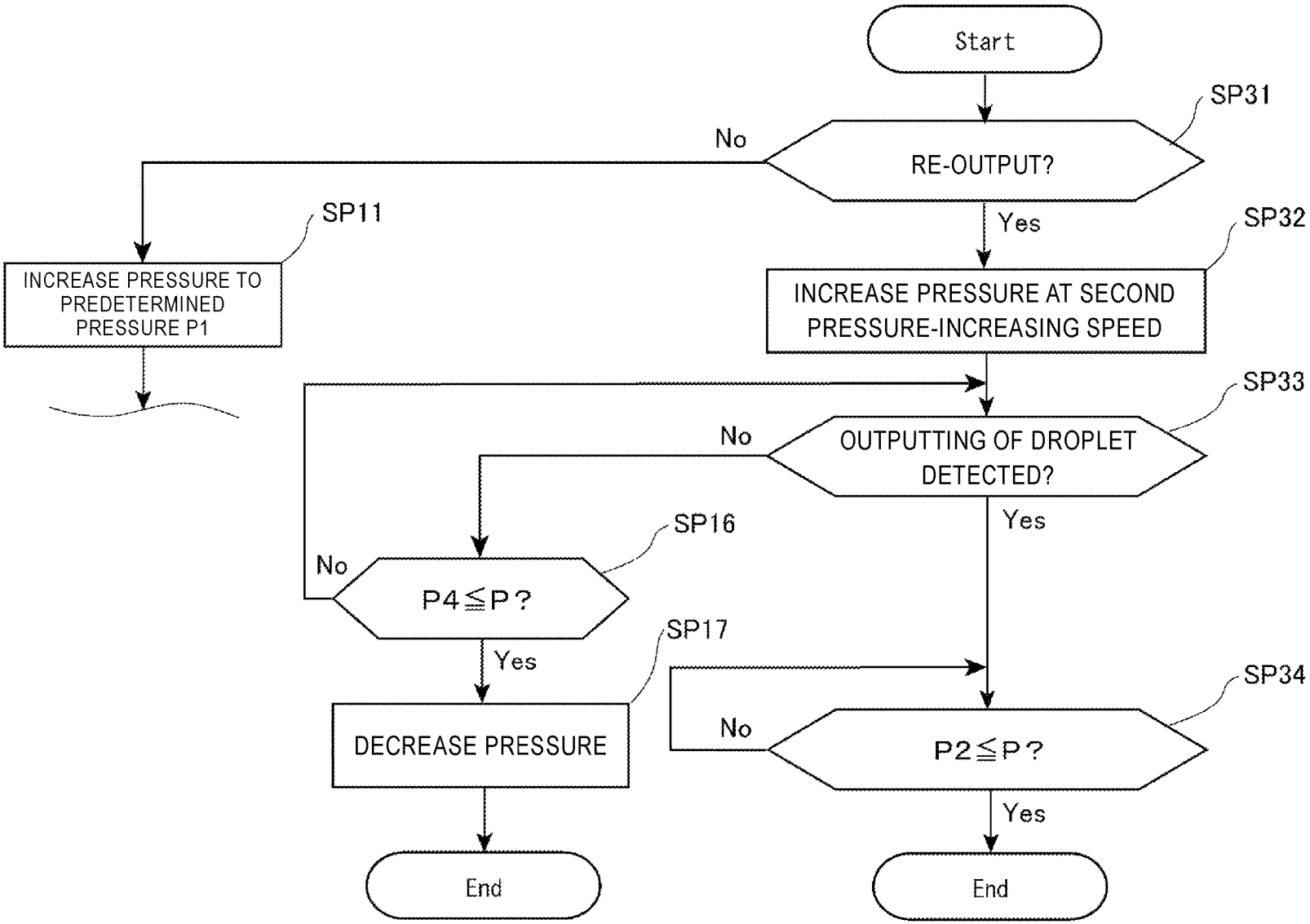
FIG. 10 is a diagram showing an example of a control flowchart of the processor according to a second embodiment.
Figure 11:
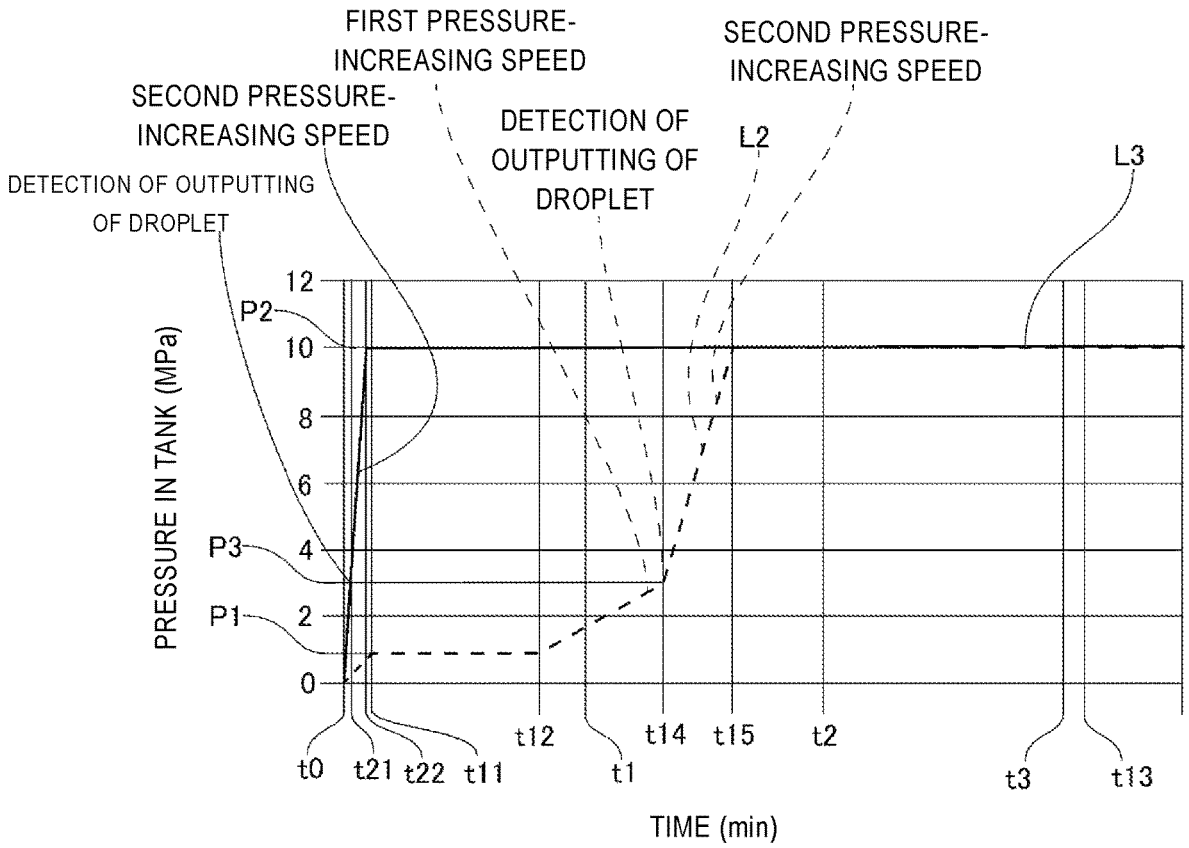
FIG. 11 is a diagram showing the relationship between the pressure in the tank when the droplet is re-output and time at which the pressure increases.

FIG. 10 is a diagram showing an example of a control flowchart of the processor 120 according to the present embodiment. As shown in FIG. 10, the control flow of the present embodiment includes steps SP31 to SP34. As will be described later, the control flow of the present embodiment further includes steps SP11 to SP17 described in the first embodiment. FIG. 11 is a diagram showing the relationship between the pressure P in steps SP31 to SP34 and the time at which the pressure increases. A solid line L3 shown in FIG. 11 indicates a change of the pressure P in steps SP31 to SP34. In FIG. 11, in order to compare the present embodiment with the first embodiment, the change of the pressure P indicated by the solid line L2 in FIG. 9 is shown by a broken line L2.

The start state shown in FIG. 10 is the start state in the first embodiment and corresponds to time t0 immediately after the start of pressurization.

(Step SP31)

In this step, the processor 120 reads out the output information from the storage device 120*a*. When the output count is 0 in the output information, the target supply device 40 is to output the droplet DL for the first time after the installation of the target supply device 40, and the processor 120 advances the control flow to step SP11 described in the first embodiment. The control flow after step SP11 includes steps SP12 to SP17 described in the first embodiment and shown in FIG. 8, so that the illustration is omitted in FIG. 10 and description thereof is also omitted in the following. When the output count is 1 or more, the target supply device 40 is to re-output the droplet DL, and the processor 120 advances the control flow to step SP32.

(Step SP32)

In this step, the processor 120 outputs a signal to the actuator of the valve 43*b* and controls the opening degree of the valve 43*b* via the actuator so that the pressure P is increased at the second pressure-increasing speed to the first target pressure P2 after time t0. Thus, when the target supply device 40 re-outputs the droplet DL, unlike when the target supply device 40 outputs the droplet DL for the first time after the installation of the target supply device 40, the pressure adjuster 43 pressurizes the inside of the tank 41 at the second pressure-increasing speed from time t0, regardless of whether or not the outputting of the droplet DL is detected by the target sensor 27. Thus, the processor 120 sets the pressure-increasing speed at the second pressure-increasing speed when the pressure P is increased from the pressure lower than the pressure P3.

In this step, since the target supply device 40 is in the state of re-outputting the droplet DL, the target substance permeates the filter 51*a* and the space between the filter 51*a* and the nozzle hole is already filled with the target substance. Therefore, even when the pressure P is increased at the second pressure-increasing speed after time t0, generation of the bubbles in the target substance in the tank 41 is suppressed, and due to the suppression, generation of particles in the target substance in the tank 41 is suppressed. In addition, when the generation of particles is suppressed, clogging of the nozzle hole due to the particles is suppressed. Further, since the space from the filter 51*a* to the nozzle hole is filled with the target substance as described above, it is possible to prevent the bubbles, which are part of the atmospheric air in the space, from entering the target substance and to prevent the trajectory of the droplet DL to be output from being disturbed. Further, since the space is filled with the target substance as described above, even when the second pressure-increasing speed is adopted, the occurrence of the pressure difference between the upstream side and the downstream side of the filter 51*a* is suppressed and a sudden impact on the filter 51*a* is suppressed.

After the processor 120 controls the pressure adjuster 43 as described above, the control flow proceeds to step SP33.

(Step SP33)

In this step, the droplet DL is output by the pressure increase of the pressure P, and when a signal indicating the detection of outputting of the droplet DL is input from the target sensor 27 to the processor 120, the processor 120 advances the control flow to step SP34. In FIG. 11, the time when the droplet DL is detected is defined as time t21. Since the second pressure-increasing speed is adopted at time t21, time t21 is earlier than time t14 and is, for example, 0.4 minutes.

(Step SP34)

In this step, the processor 120 returns the control flow to step SP34 when the pressure P indicated by the signal input from the pressure sensor 43*e* is lower than the first target pressure P2. Thus, the pressure adjuster 43 pressurizes the inside of the tank 41 to the first target pressure P2 continuously at the second pressure-increasing speed. On the other hand, when the pressure P becomes the first target pressure P2, the processor 120 controls the opening degree of the valve 43*b* by the above-described feedback control. As a result, decrease in the pressure P is suppressed, and the pressure P remains at the first target pressure P2. In FIG. 11, the time when the pressure P reaches the first target pressure P2 at the second pressure-increasing speed is defined as time t22. Time t22 is earlier than time t15 and is, for example, 0.8 minutes. Therefore, the pressure P remains at the first target pressure P2 after time t22. The processor 120 maintains the first target pressure P2 by controlling the valve 43*b* as described above. After the processor 120 controls the pressure adjuster 43 as described above, the control flow ends.

Further, in step SP33, when a signal not indicating the detection of the outputting of the droplet DL is input to the processor 120 from the target sensor 27, the processor 120 advances the control flow to step SP16. The control flow after step SP16 includes step SP17 described in the first embodiment and described above, so that description thereof is omitted.

5.3 Effect

In the target supply device 40 of the present embodiment, in a state where the detection of the outputting of the droplet DL by the target sensor 27 is not the detection for the first time after the installation of the target supply device 40, the processor 120 sets the pressure-increasing speed to the second pressure-increasing speed when the pressure P in the tank 41 is to be increased from the pressure lower than the pressure at which the outputting of the droplet DL is detected by the target sensor 27 for the first time after the installation of the target supply device 40.

As described above, it is considered that the unstable state of the droplet DL is caused by a wet state or the like at the edge of the nozzle hole. When the droplet DL is to be re-output, the edge of the nozzle hole is formed in a more wet state than that at the previous output. Therefore, in the case where the droplet DL is re-output, the unstable state of the droplet DL can be suppressed as compared with the case where the droplet DL is output for the first time after the installation of the target supply device 40. Further, if the droplet DL is output once, the bubbles in the space from the filter 51*a* to the nozzle hole are discharged from the nozzle hole, and the entering of the bubbles into the target substance during the re-outputting of the droplet DL is suppressed. In this state, the pressure-increasing speed of the pressure P becomes the second pressure-increasing speed immediately after the start of pressurization, and thus the pressure P can be increased to the first target pressure P2 regardless of the detection of the outputting of the droplet DL by the target sensor 27. Further, in the target supply device 40 according to the present embodiment, the pressure P can be increased to the first target pressure P2 in a shorter time than in the case where the pressure P is increased at the first pressure-increasing speed and second pressure-increasing speed. Therefore, in the target supply device 40 of the present embodiment, the droplet DL can be immediately supplied to the plasma generation region AR when the droplet DL is re-output.

When the output count is one or more, the processor 120 sets the pressure-increasing speed of the pressure P to the second pressure-increasing speed immediately after the start of pressurization by the pressure adjuster 43, but it is not limited thereto. The processor 120 may set the pressure-increasing speed of the pressure P to the second pressure-increasing speed before the signal indicating the detection of the outputting of the droplet DL is input from the target sensor 27 to the processor 120.

Here, although the storage device 120*a* of the processor 120 is used as the storage device for storing the output information, the storage device may be arranged outside the processor 120 as a device different from the storage device 120*a*. In this case, the storage device is electrically connected to the processor 120. The storage device is, for example, a non-transitory recording medium, and is preferably a semiconductor recording medium such as a random access memory (RAM) or a read only memory (ROM). However, the storage device may include a recording medium of an arbitrary format such as an optical recording medium or a magnetic recording medium. The non-transitory recording medium includes all computer-readable recording media except for transitory propagation signals, and does not exclude volatile recording media.

6. Description of Extreme Ultraviolet Light Generation Apparatus of Third Embodiment Next, the configuration of the EUV light generation apparatus 100 of a third embodiment will be described. Any component same as that described above is denoted by an identical reference sign, and duplicate description thereof is omitted unless specific description is needed.

6.1 Configuration

Figure 12:
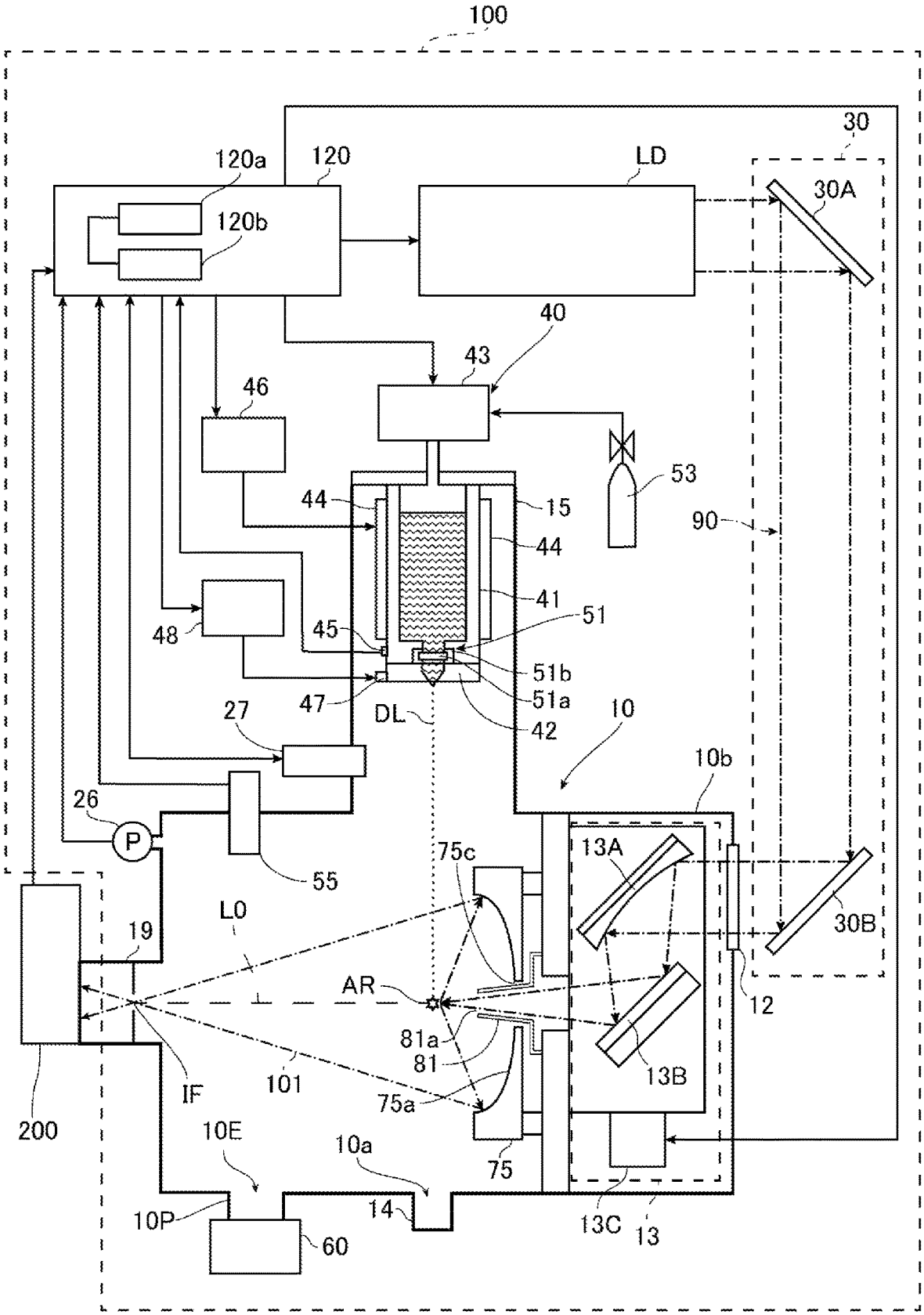
FIG. 12 is a schematic view showing a schematic configuration example of the entire EUV light generation apparatus of a third embodiment.

FIG. 12 is a schematic view showing a schematic configuration example of the entire EUV light generation apparatus 100 of the third embodiment. In the EUV light generation apparatus 100 of the present embodiment, the configuration of the droplet detector differs from that of the droplet detector of the first embodiment.

The droplet detector of the present embodiment is not the target sensor 27 but the gas detector 55 that detects the inert gas discharged from the nozzle hole to the internal space of the chamber device 10. The inert gas stays in the space between the filter 51*a* and the nozzle hole before the target substance is filled in the space, is pushed out from the nozzle hole to the internal space of the chamber device 10 by the outputting of the droplet DL, and is discharged together with the droplet DL. The gas detector 55 is arranged at the internal space of the chamber device 10, detects the inert gas at the internal space of the chamber device 10, and detects the outputting of the droplet DL by detecting the inert gas. The gas detector 55 is electrically connected to the processor 120. The processor 120 detects increase of the inert gas at the internal space of the chamber device 10 based on a signal from the gas detector 55.

The gas detector 55 is, for example, a gas analyzer or a vacuum gauge. The vacuum gauge is, for example, a Pirani vacuum gauge or an ion gauge.

6.2 Operation

Next, operation of the processor 120 for controlling the pressure P in the tank 41 in the present embodiment will be described.

Figure 13:
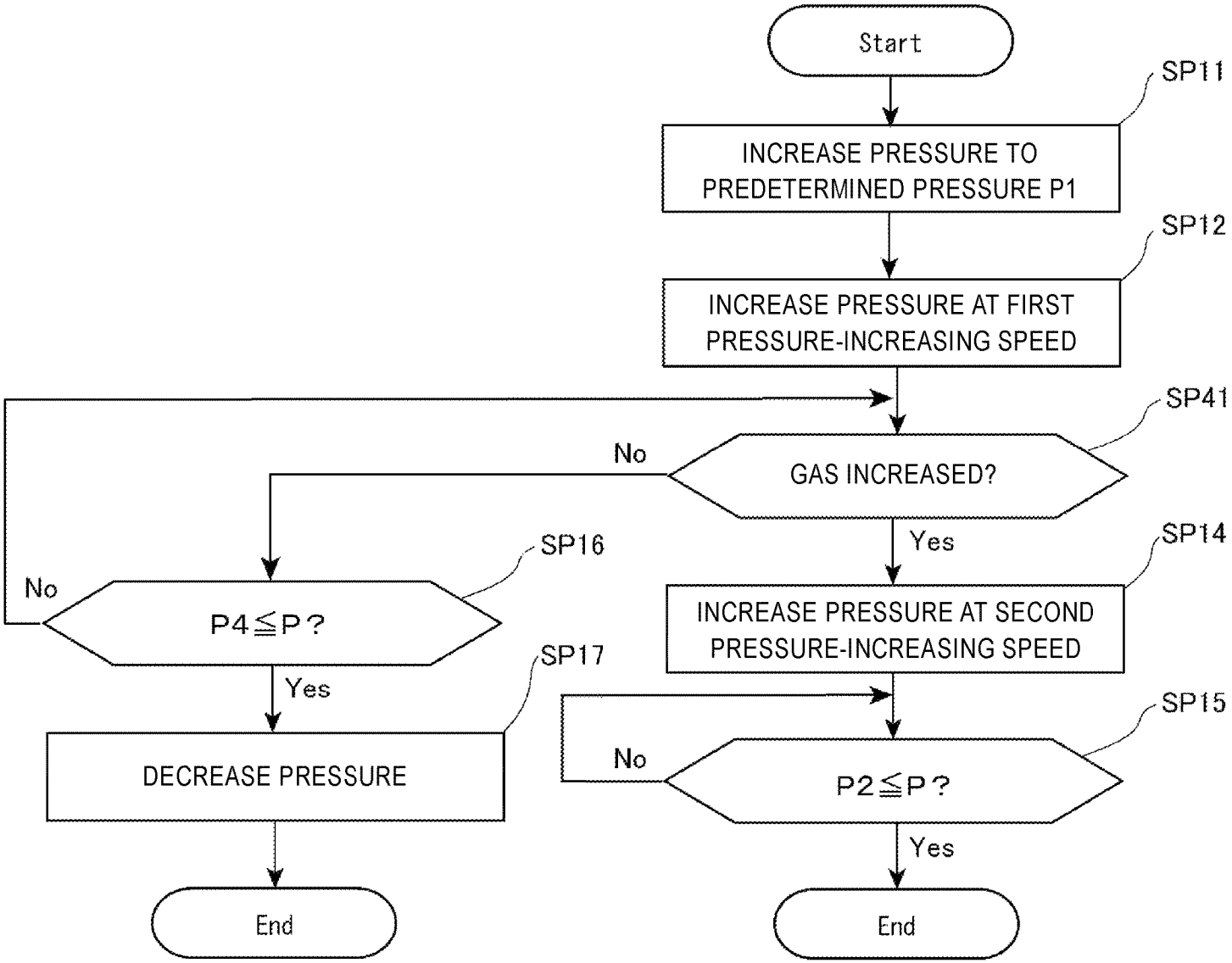
FIG. 13 is a diagram showing an example of a control flowchart of the processor according to the third embodiment.

FIG. 13 is a diagram showing an example of a control flowchart of the processor 120 according to the present embodiment. The control flow of the present embodiment differs from the control flow of the first embodiment in that step SP41 is included instead of step SP13 in the control flow of the first embodiment. Further, in the start state of the present embodiment, unlike the first embodiment, the signal is input from the gas detector 55 to the processor 120.

(Step SP41)

In this step, when the signal is input from the gas detector 55 to the processor 120 and the amount of the inert gas at the internal space of the chamber device 10 is increased, the processor 120 advances the control flow to step SP14.

Further, in this step, when the inert gas at the internal space of the chamber device 10 is not increased, the processor 120 advances the control flow to step SP16.

6.3 Effect

In the target supply device 40 of the present embodiment, the gas detector 55 being the droplet detector detects the inert gas at the internal space of the chamber device 10. When the inert gas is discharged from the tank 41 into the internal space of the chamber device 10 by the outputting of the droplet DL, the amount of the inert gas at the internal space of the chamber device 10 increases. Therefore, even when the gas detector 55 is used, the outputting of the droplet DL can be detected. When the internal space of the chamber device 10 is maintained at a low pressure, even if a small amount of the inert gas is discharged from the nozzle 42, the inert gas tends to instantaneously diffuse to the internal space of the chamber device 10. In this case, the gas detector 55 may be arranged anywhere at the internal space of the chamber device 10 as long as it can detect the inert gas. Therefore, the degree of freedom of arrangement can be increased as compared with the case where the arrangement position of the droplet detector is determined to one position.

The description above is intended to be illustrative and the present disclosure is not limited thereto. Therefore, it would be obvious to those skilled in the art that various modifications to the embodiments of the present disclosure would be possible without departing from the spirit and the scope of the appended claims. Further, it would be also obvious to those skilled in the art that embodiments of the present disclosure would be appropriately combined.

The terms used throughout the present specification and the appended claims should be interpreted as non-limiting terms unless clearly described. For example, terms such as "comprise", "include", "have", and "contain" should not be interpreted to be exclusive of other structural elements. Further, indefinite articles "a/an" described in the present specification and the appended claims should be interpreted to mean "at least one" or "one or more." Further, "at least one of A, B, and C" should be interpreted to mean any of A, B, C, A+B, A+C, B+C, and A+B+C as well as to include combinations of any thereof and any other than A, B, and C.

What is claimed is:

1. A target supply device comprising:

a tank configured to store a target substance;

a pressure adjuster configured to adjust a pressure in the tank;

a filter configured to filter the target substance in the tank;

a nozzle configured to output a droplet of the target substance having passed through the filter;

a droplet detector configured to detect outputting of the droplet from the nozzle; and a processor configured to control the pressure adjuster so that a pressure-increasing speed of the pressure in the tank is higher after detection of outputting of the droplet than before detection of outputting of the droplet, during a period in which the pressure in the tank is increased to a target pressure from a pressure at which outputting of the droplet is detected by the droplet detector for the first time after installation of the target supply device.

2. The target supply device according to claim 1, wherein the processor increases the pressure-increasing speed to be higher than that before detection of outputting of the droplet after a predetermined time elapses since the droplet detector detects outputting of the droplet for the first time after installation of the target supply device.

3. The target supply device according to claim 2, wherein the predetermined time is 1 ms or more and 1 s or less.

4. The target supply device according to claim 1, wherein the processor increases the pressure-increasing speed to be higher than that before detection of outputting of the droplet until the pressure in the tank is increased to a pressure approximately 90% of the target pressure from the pressure at which outputting of the droplet is detected by the droplet detector for the first time after installation of the target supply device.

5. The target supply device according to claim 1, wherein the processor increases the pressure-increasing speed to be higher than that before detection of outputting of the droplet until the pressure in the tank is increased from the pressure at which outputting of the droplet is detected by the droplet detector for the first time after installation of the target supply device to a pressure approximately 130% of the pressure.

6. The target supply device according to claim 1, wherein, in a state where detection of outputting of the droplet by the droplet detector is not detection by the droplet detector for the first time after installation of the target supply device, the processor sets the pressure-increasing speed to the speed increased after outputting of the droplet is detected by the droplet detector for the first time after installation of the target supply device when the pressure in the tank is to be increased from a pressure lower than the pressure at which outputting of the droplet is detected by the droplet detector for the first time after installation of the target supply device.

7. The target supply device according to claim 1, wherein, in a case where outputting of the droplet is not detected by the droplet detector and the pressure in the tank is higher than the pressure in the tank assumed when outputting of the droplet is detected by the droplet detector for the first time after installation of the target supply device, the processor controls the pressure adjuster so that the pressure in the tank is decreased.

8. The target supply device according to claim 7, wherein the processor controls the pressure adjuster so that the pressure in the tank is decreased to be lower than the pressure in the tank assumed when outputting of the droplet is detected by the droplet detector for the first time after installation of the target supply device.

9. The target supply device according to claim 1, wherein the droplet detector detects outputting of the droplet by imaging the droplet.

10. The target supply device according to claim 1, wherein the droplet detector detects outputting of the droplet by detecting gas discharged from the inside of the tank through the nozzle by the outputting of the droplet.

11. The target supply device according to claim 1, wherein the pressure adjuster includes:

a supply path communicating with a gas supply source and the tank and configured to supply gas to the tank from the gas supply source;

an exhaust path including an exhaust port, communicating with the supply path, and configured to exhaust the gas in the tank through the exhaust port;

a valve for pressurization arranged in the supply path;

a valve for depressurization arranged in the exhaust path; and a pressure sensor arranged in the supply path.

12. The target supply device according to claim 1, wherein the pressure-increasing speed after detection of outputting of the droplet is 0.2 MPa/s or higher and 1 Mpa/s or lower.

13. The target supply device according to claim 1, wherein the pressure-increasing speed before detection of outputting of the droplet is 0.002 MPa/s or higher and 0.0067 MPa/s or lower.

14. The target supply device according to claim 1, wherein the pressure-increasing speed before detection of outputting of the droplet is a speed immediately before outputting of the droplet is detected by the droplet detector for the first time after installation of the target supply device.

15. An extreme ultraviolet light generation apparatus, comprising:

a chamber device including a plasma generation region;

a target supply device configured to supply a droplet of a target substance to the plasma generation region; and a laser device configured to irradiate the droplet with laser light so that plasma is generated from the droplet in the plasma generation region, the target supply device including:

a tank configured to store the target substance;

a pressure adjuster configured to adjust a pressure in the tank;

a filter configured to filter the target substance in the tank;

a nozzle configured to output the droplet of the target substance having passed through the filter;

a droplet detector configured to detect outputting of the droplet from the nozzle; and a processor configured to control the pressure adjuster so that a pressure-increasing speed of the pressure in the tank is higher after detection of outputting of the droplet than before detection of outputting of the droplet, during a period in which the pressure in the tank is increased to a target pressure from a pressure at which outputting of the droplet is detected for the first time by the droplet detector after installation of the target supply device.

16. An electronic device manufacturing method, comprising:

generating plasma by irradiating a target substance with laser light using an extreme ultraviolet light generation apparatus;

emitting extreme ultraviolet light generated from the plasma to an exposure apparatus; and exposing a photosensitive substrate to the extreme ultraviolet light in the exposure apparatus to manufacture an electronic device, the extreme ultraviolet light generation apparatus including:

a chamber device including a plasma generation region;

a target supply device configured to supply a droplet of the target substance to the plasma generation region; and a laser device configured to irradiate the droplet with the laser light so that the plasma is generated from the droplet in the plasma generation region, and the target supply device including:

a tank configured to store the target substance;

a pressure adjuster configured to adjust a pressure in the tank;

a filter configured to filter the target substance in the tank;

a nozzle configured to output the droplet of the target substance having passed through the filter;

a droplet detector configured to detect outputting of the droplet from the nozzle; and a processor configured to control the pressure adjuster so that a pressure-increasing speed of the pressure in the tank is higher after detection of outputting of the droplet than before detection of outputting of the droplet, during a period in which the pressure in the tank is increased to a target pressure from a pressure at which outputting of the droplet is detected for the first time by the droplet detector after installation of the target supply device.

17. An electronic device manufacturing method, comprising:

generating plasma by irradiating a target substance with laser light using an extreme ultraviolet light generation apparatus;

inspecting a defect of a mask by irradiating the mask with extreme ultraviolet light generated from the plasma;

selecting a mask using a result of the inspection; and exposing and transferring a pattern formed on the selected mask onto a photosensitive substrate, the extreme ultraviolet light generation apparatus including:

a chamber device including a plasma generation region;

a target supply device configured to supply a droplet of the target substance to the plasma generation region; and a laser device configured to irradiate the droplet with the laser light so that the plasma is generated from the droplet in the plasma generation region, and the target supply device including:

a tank configured to store the target substance;

a pressure adjuster configured to adjust a pressure in the tank;

a filter configured to filter the target substance in the tank;

a nozzle configured to output the droplet of the target substance having passed through the filter;

a droplet detector configured to detect outputting of the droplet from the nozzle; and a processor configured to control the pressure adjuster so that a pressure-increasing speed of the pressure in the tank is higher after detection of the outputting of the droplet than before detection of the outputting of the droplet, during a period in which the pressure in the tank is increased to a target pressure from a pressure at which the outputting of the droplet is detected for the first time by the droplet detector after installation of the target supply device.

* * * * *